US012409996B2

(12) United States Patent
Crawford et al.

(10) Patent No.: US 12,409,996 B2
(45) Date of Patent: Sep. 9, 2025

(54) PACKAGE WITH MULTIPLE COMPARTMENTS

(71) Applicant: Altria Client Services LLC, Richmond, VA (US)

(72) Inventors: Danielle Crawford, Richmond, VA (US); Dwight David Williams, Powhatan, VA (US); Gregory H. Ray, Richmond, VA (US)

(73) Assignee: Altria Client Services LLC, Richmond, VA (US)

( * ) Notice: Subject to any disclaimer, the term of this patent is extended or adjusted under 35 U.S.C. 154(b) by 199 days.

(21) Appl. No.: 18/185,766

(22) Filed: Mar. 17, 2023

(65) Prior Publication Data

US 2024/0308747 A1 Sep. 19, 2024

(51) Int. Cl.
*B65D 81/26* (2006.01)
*B65D 33/00* (2006.01)
(Continued)

(52) U.S. Cl.
CPC ..... *B65D 77/02* (2013.01); *B65D 33/008* (2013.01); *B65D 33/14* (2013.01); *B65D 77/12* (2013.01); *B65D 81/264* (2013.01)

(58) Field of Classification Search
CPC ..... B65D 33/2533; B65D 2209/00; B65D 75/566; B65D 75/5805; B65D 77/062;
(Continued)

(56) References Cited

U.S. PATENT DOCUMENTS 1,386,398 A * 8/1921 Davis ..... A47K 1/09 206/820
3,226,010 A 12/1965 Rogers, Jr.
(Continued)

FOREIGN PATENT DOCUMENTS

CN 1736818 A 2/2006
CN 108350664 A 7/2018
(Continued)

OTHER PUBLICATIONS

American Society for Testing and Materials (ASTM) standard D-3985-17, "Standard Test Method of Oxygen Gas Transmission Rate through Plastic Film and Sheeting Using a Coulometric Sensor", Dec. 2017.
(Continued)

*Primary Examiner* — Luan K Bui
(74) *Attorney, Agent, or Firm* — Harness, Dickey & Pierce, P.L.C.

(57) ABSTRACT

The package includes an inner package including a first panel defining a first compartment, the first panel including a first end that is at least partially heat sealed, the first end defining a first tear-point, a second panel defining a second compartment, a first interfacing edge of the first panel being connected to a second interfacing edge of the second panel, the second panel including a second end that is at least partially heat sealed, the second end defining a second tear-point, the first re-closeable seal and the second re-closeable seal being on a third end of the first compartment and a fourth end of the at least one second compartment, respectively.

19 Claims, 30 Drawing Sheets

(51) Int. Cl.

| | |
|---|---|
| ***B65D 33/14*** | (2006.01) |
| ***B65D 75/58*** | (2006.01) |
| ***B65D 77/02*** | (2006.01) |
| ***B65D 77/12*** | (2006.01) |

(58) Field of Classification Search
CPC ..... B65D 81/326; B65D 81/266; B65D 81/268
USPC ..... 206/204, 499, 806, 820; 383/63, 95
See application file for complete search history.

(56) References Cited

U.S. PATENT DOCUMENTS

| | | | | |
|---|---|---|---|---|
| 4,081,126 | A | 3/1978 | Barnard | |
| 4,764,404 | A | 8/1988 | Genske et al. | |
| 4,972,657 | A * | 11/1990 | McKee | B65D 33/002 53/449 |
| 5,077,104 | A | 12/1991 | Hunt et al. | |
| 5,291,990 | A * | 3/1994 | Sejzer | B65D 75/42 206/820 |
| 5,551,557 | A | 9/1996 | Brooks et al. | |
| 5,667,863 | A | 9/1997 | Cullen et al. | |
| 5,698,250 | A | 12/1997 | DelDuca et al. | |
| 5,711,423 | A | 1/1998 | Fuller, Jr. | |
| 5,718,347 | A | 2/1998 | Walker et al. | |
| 5,906,438 | A * | 5/1999 | Laudenberg | B65D 33/2508 383/107 |
| 6,054,153 | A | 4/2000 | Carr et al. | |
| 6,071,626 | A | 6/2000 | Frisk | |
| 6,119,853 | A | 9/2000 | Garrill et al. | |
| 6,176,371 | B1 * | 1/2001 | Tyrrell | B01L 3/505 53/469 |
| 6,183,790 | B1 | 2/2001 | DelDuca et al. | |
| 6,274,210 | B1 | 8/2001 | Ebner et al. | |
| 6,325,974 | B1 | 12/2001 | Ahvenainen et al. | |
| 6,688,468 | B2 | 2/2004 | Waterman | |
| 6,746,772 | B2 | 6/2004 | Kashiba et al. | |
| 6,962,439 | B2 * | 11/2005 | Taheri | B65D 33/2566 383/204 |
| 7,285,334 | B1 | 10/2007 | Yamashita et al. | |
| 7,494,605 | B2 | 2/2009 | Dayrit et al. | |
| 7,708,719 | B2 | 5/2010 | Wilmot et al. | |
| 8,006,860 | B2 | 8/2011 | Klein | |
| 8,623,481 | B2 | 1/2014 | Chau | |
| 8,985,322 | B2 | 3/2015 | Cullison | |
| 9,199,778 | B2 | 12/2015 | Masuda et al. | |
| 9,248,229 | B2 | 2/2016 | Devouassoux et al. | |
| 9,617,049 | B2 | 4/2017 | Dey | |
| 10,518,243 | B2 | 12/2019 | Macko et al. | |
| 10,773,862 | B2 | 9/2020 | Ziering et al. | |
| 2004/0111287 | A1 | 6/2004 | Singh | |
| 2005/0085577 | A1 | 4/2005 | Ching et al. | |
| 2009/0269647 | A1 | 10/2009 | Imoda et al. | |
| 2011/0243483 | A1 | 10/2011 | Crump et al. | |
| 2012/0282376 | A1 | 11/2012 | Crawford | |
| 2013/0213827 | A1 * | 8/2013 | Hammad | B65D 85/00 206/204 |
| 2013/0310252 | A1 | 11/2013 | Sakamoto et al. | |
| 2014/0087033 | A1 | 3/2014 | McKedy | |
| 2014/0087034 | A1 | 3/2014 | McKedy | |
| 2014/0311099 | A1 | 10/2014 | Uradnisheck | |
| 2014/0366491 | A1 | 12/2014 | McAffer et al. | |
| 2015/0064686 | A1 | 3/2015 | Fuller | |
| 2015/0366264 | A1 | 12/2015 | Theron | |
| 2016/0145030 | A1 * | 5/2016 | Malligan | A23L 25/20 426/120 |
| 2018/0002061 | A1 | 1/2018 | Mitten et al. | |
| 2018/0354702 | A1 | 12/2018 | Liu et al. | |
| 2019/0084702 | A1 | 3/2019 | Thesing et al. | |
| 2019/0289907 | A1 | 9/2019 | Van Lancker et al. | |

FOREIGN PATENT DOCUMENTS

| | | | |
|---|---|---|---|
| JP | H03148406 | A | 6/1991 |
| WO | WO-9824625 | A1 | 6/1998 |

OTHER PUBLICATIONS

American Society for Testing and Materials (ASTM) standard F1249-06, "Standard Test Method for Water Vapor Transmission Rate Through Plastic Film and Sheeting Using a Modulated Infrared Sensor", 2006.
CSP Technologies, "Moisture- and Oxygen-absorbing Films", retrieved Mar. 1, 2016.
International Preliminary Report on Patentability dated Jul. 1, 2021, issued in International Application No. PCT/EP2019/085104.
International Search Report dated Mar. 23, 2020, issued in International Application No. PCT/EP2019/085104.
Mahajan et al., "The Effect of Inert Atmospheric Packaging on Oxidative Degradation in Formulated Granules", Springer Science-Business Media, Inc., 4 pages, 2005.
Office Action dated Aug. 30, 2022, issued in Chinese Patent Application No. 201980077408.X.
Office Action dated Feb. 21, 2023, issued in Brazilian Patent Application No. 1120210096728.
Sorbentsystems, "Sorbents: Desiccants, Oxygen Absorbers, Silica Gel Paper, Indicators and more . . . ", retrieved Mar. 1, 2016.
Wikipedia, "Oxygen Scavenger", retrieved Mar. 1, 2016.
Written Opinion dated Mar. 23, 2020, issued in International Application No. PCT/EP2019/085104.

* cited by examiner

PACKAGE WITH MULTIPLE COMPARTMENTS

BACKGROUND

Field

Example embodiments generally relate to a multi-compartment package.

Description of Related Art

Packages can be used to store, transport and sell consumer products. The consumer products may be more enjoyable to consume when fresh. The consumer products may need to be disposed of following consumption.

SUMMARY

At least one example embodiment is directed toward a package.

In at least one example embodiment, the package includes an inner package including a first panel defining a first compartment, the first panel including a first end that is at least partially heat sealed, the first end defining a first tear-point that is configured to allow a first portion of the first end to be removed to allow access to a first re-closeable seal, a second panel defining a second compartment, a first interfacing edge of the first panel being connected to a second interfacing edge of the second panel, the second panel including a second end that is at least partially heat sealed, the second end defining a second tear-point that is configured to allow a second portion of the second end to be removed to allow access to a second re-closeable seal, and the first re-closeable seal and the second re-closeable seal being on a third end of the first compartment and a fourth end of the at least one second compartment, respectively.

In at least one example embodiment, the first panel and the second panel are configured to be folded onto each other.

In at least one example embodiment, the first end defines a first slit and the second end defines a second slit, and the first slit and the second slit are configured to align once the first panel and the second panel are folded onto each other.

In at least one example embodiment, the first compartment includes a first empty compartment that is empty, and the second compartment includes a first filled compartment containing a first set of pouches and a second filled compartment containing a second set of pouches.

In at least one example embodiment, the first empty compartment is a different size than the first filled compartment and the second filled compartment.

In at least one example embodiment, each of the first set of pouches and the second set of pouches includes a quantity of consumer product pouches that are to be consumed during a first expected duration of time based on an average consumption rate.

In at least one example embodiment, the first expected duration of time is shorter than a second expected duration of time, the second expected duration of time being a time period upon which flavor scalping is expected to occur for the quantity of the consumer product pouches following an exposure to ambient air.

In at least one example embodiment, the package further includes an outer package, wherein the inner package is inside the outer package.

In at least one example embodiment, the package further includes an outer package, the inner package being contained in the outer package, wherein the first end defines a first slit and the second end defines a second slit, the at least one first panel and the at least one second panel being folded onto each other such that the first slit is aligned with the second slit, and the outer package defines at least one third slit, the at least one third slit being aligned with the first slit and the second slit.

In at least one example embodiment, at least one tear line is defined by the first interfacing edge and the second interfacing edge.

In at least one example embodiment, the package further includes an adhesive on at least a portion of a major interfacing surface between each of the first panel and the second panel to hold the inner package in a folded configuration, the folded configuration including the first panel and the second panel being folded onto each other.

In at least one example embodiment, the first panel includes a plurality of first panels that are subdivided by tear lines, the plurality of first panels defining a plurality of first compartments that are the same as the first compartment.

In at least one example embodiment, the plurality of first panels and the second panel are folded onto each other in an accordion configuration, and the inner package is configured to allow at least one of a first end panel or a second end panel, of the plurality of first panels and the second panel, to be separated and extended from sides of the accordion configuration.

In at least one example embodiment, at least one tear line is defined by the inner package, the at least one tear line being configured to allow at least one of the first end panel or the second end panel to be removed from a remainder of the inner package.

In at least one example embodiment, the plurality of first panels and the second panel are made from a recyclable material.

In at least one example embodiment, the plurality of first compartments include one or more empty compartments, and the second panel includes a plurality of second compartments that define a plurality of second compartments, each one of the plurality of second compartments being filled compartments containing sets of pouches of a consumer product.

In at least one example embodiment, the first panel and the second panel are made from a recyclable material.

In at least one example embodiment, the first panel and the second panel are made from a layer of material, the layer of material including at least one first polymer layer and a gas/moisture impermeable layer, the at least one first polymer layer forming an interior surface of the first compartment and the second compartment.

In at least one example embodiment, the gas/moisture impermeable layer is a foil layer.

In at least one example embodiment, the first panel and the second panel are made from a layer of material that includes at least one gas/moisture impermeable layer, and an oxygen scavenger is one of enclosed within the first compartment, enclosed within the second compartment, infused within the layer of material, or connected to or infused with an inner layer of the layer of material, the inner layer forming an interior surface of the first compartment and the second compartment.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

DETAILED DESCRIPTION

Figure 1:
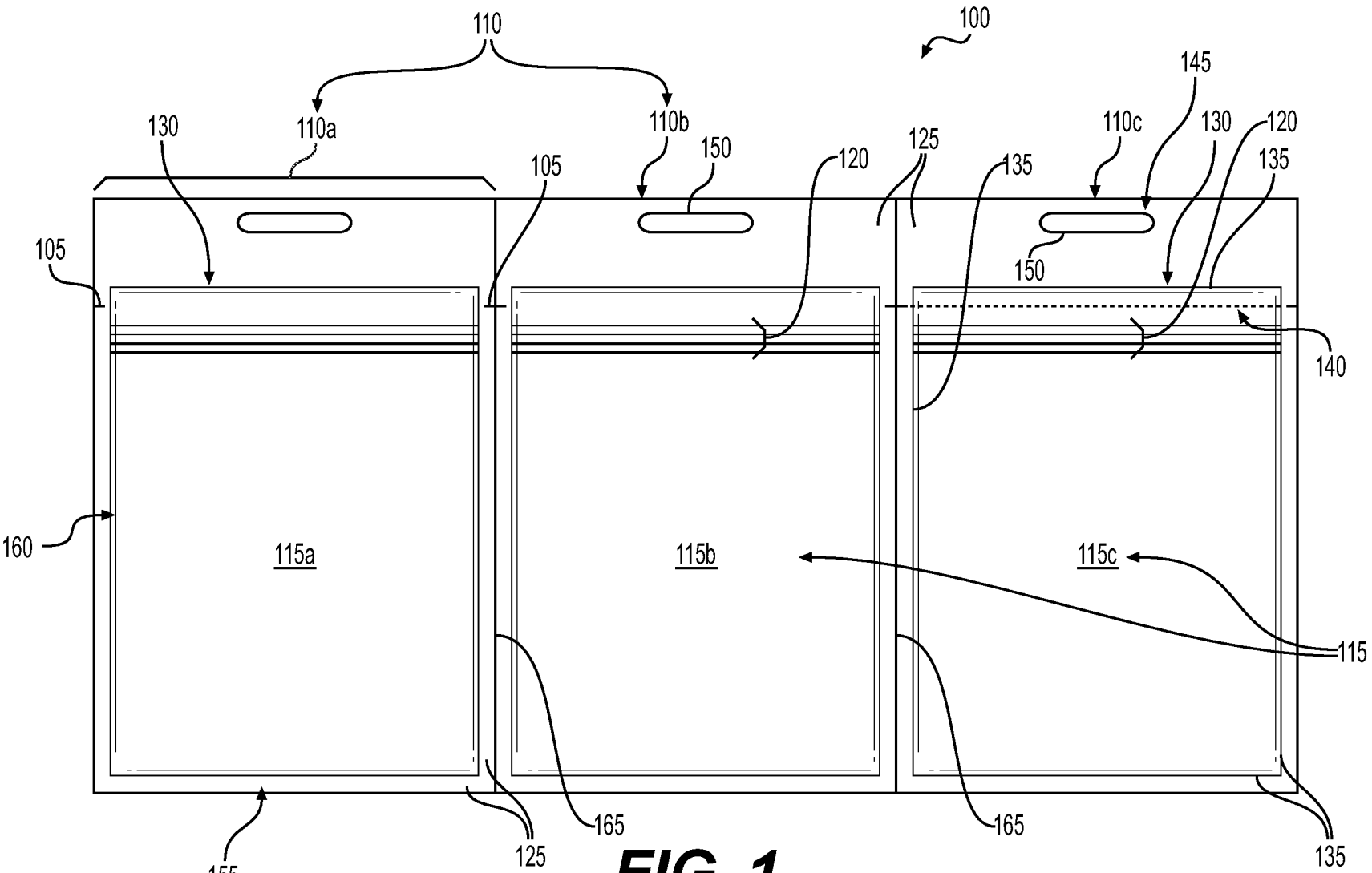
FIG. 1 is an illustration of an inner package, in accordance with at least one example embodiment.

Some detailed example embodiments are disclosed herein. However, specific structural and functional details disclosed herein are merely representative for purposes of describing example embodiments. Example embodiments may, however, be embodied in many alternate forms and should not be construed as limited to only the example embodiments set forth herein.

Accordingly, while example embodiments are capable of various modifications and alternative forms, example embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives thereof. Like numbers refer to like elements throughout the description of the figures.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations or sub-combinations of one or more of the associated listed items.

It should be understood that, although the terms first, second, third, etc. may be used herein to describe various elements, regions, layers and/or sections, these elements, regions, layers, and/or sections should not be limited by these terms. These terms are only used to distinguish one element, region, layer, or section from another region, layer, or section. Thus, a first element, region, layer, or section discussed below could be termed a second element, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various example embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, and/or elements, but do not preclude the presence or addition of one or more other features, integers, steps, operations, elements, and/or groups thereof.

When the words "about" and "substantially" are used in this specification in connection with a numerical value, it is intended that the associated numerical value include a tolerance of ±10% around the stated numerical value, unless otherwise explicitly defined.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the shapes of regions illustrated herein but are to include deviations in shapes that result, for example, from manufacturing.

FIG. 1 is an illustration of an inner package 100, in accordance with an example embodiment.

In at least one example embodiment, the inner package 100 includes panels 110. In at least one example embodiment, the panels 110 are connected in a side-by-side configuration, as shown in FIG. 1. In at least one example embodiment, the inner package 100 includes a first panel 110*a*, a second panel 110*b* and a third panel 110*c*. In at least one example embodiment, each of the panels 110 defines a compartment 115. In another example embodiment, each panel 110 defines more than one compartment 115. In at least one example embodiment, the first panel 110*a* defines a first compartment 115*a*, the second panel 110*b* defines a second compartment 115*b* and the third panel 110*c* defines a third compartment 115*c*.

In at least one example embodiment, a re-closeable seal 120 is on an end 130 of each of the compartments 115. In at least one example embodiment, the re-closeable seal 120 allows the end 130 of each of the compartments 115 to individually be opened and re-closed. In at least one example embodiment, the re-closeable seals 120 are collinearly aligned with each other across the panels 110 (as shown in FIG. 1).

In at least one example embodiment, each of the panels 110 includes a heat sealed region 125 (explained in better detail in FIGS. 15A-15G). In at least one example embodiment, a border 135 exists between the heat sealed region 125 and each of the compartments 115. In at least one example embodiment, the heat sealed region 125 surrounds (encompasses) each of the compartments 115.

In at least one example embodiment, a tear-point 105 is adjacent to the end 130 of each of the compartments 115. In at least one example embodiment, the tear-point 105 is on one or both sides of each of the compartments 115, near the re-closeable seal 120. In at least one example embodiment, the tear-point 105 is aligned between the re-closeable seal 120 and the border 135 at the end 130 of the compartment 115 (see alignment line 140).

In at least one example embodiment, the tear-point 105 is a slit, a weakened or thinned area, a notch, combinations thereof, etc. In at least one example embodiment, the tear-point 105 is included on the inner package 100 to make the inner package 100 child-resistant. In at least one example embodiment, the tear-point 105 includes visual indicia indicating that the panel 110 of the inner package 100 is to be opened at this point. In at least one example embodiment, the visual indicia include a visible strip, a color, an arrow, text, a visible indentation, a change in texture or thickness, other visual indicators, or combinations thereof.

In at least one example embodiment, the inner package 100 does not include a tear-point 105. In at least one example embodiment, the inner package 100 is opened by being cut (for example, by using scissors), rather than by being torn open manually. In at least one example embodiment, the inner package 100 is made from a durable material that only allows for cutting, rather than tearing.

In at least one example embodiment, an end 145 of one or more of the panels 110, or all of the panels 110, includes a slit 150. In at least one example embodiment, the slit 150 is sized so that the inner package 100 is able to be hung on a hanger 800 (see FIG. 8) of a consumer display rack. In at least one example embodiment, the slit 150 is adjacent to an end (upper end) 130 of the compartment 115. In another example embodiment, the slit 150 is adjacent to a lower end 155 of the compartment 115, or near a side edge 160 of the compartments 115. In at least one example embodiment, the slit 150 traverses through the heat sealed region 125 of one or more of the panels 110, or all of the panels 110 (as shown in FIG. 1).

In at least one example embodiment, a divider 165 exists along interfacing edges of each of the panels 110. In at least one example embodiment, the interfacing edges are side edges of each of the panels 110. In at least one example embodiment, the divider 165 is an embossed line or a fold line. In at least one example embodiment, the divider 165 is a perforated or a weakened line. In at least one example embodiment, the panels 110 are able to be separated along the divider 165 (see at least FIG. 13). In at least one example embodiment, the divider 165 is bracketed by the heat sealed region 125.

Figure 2:
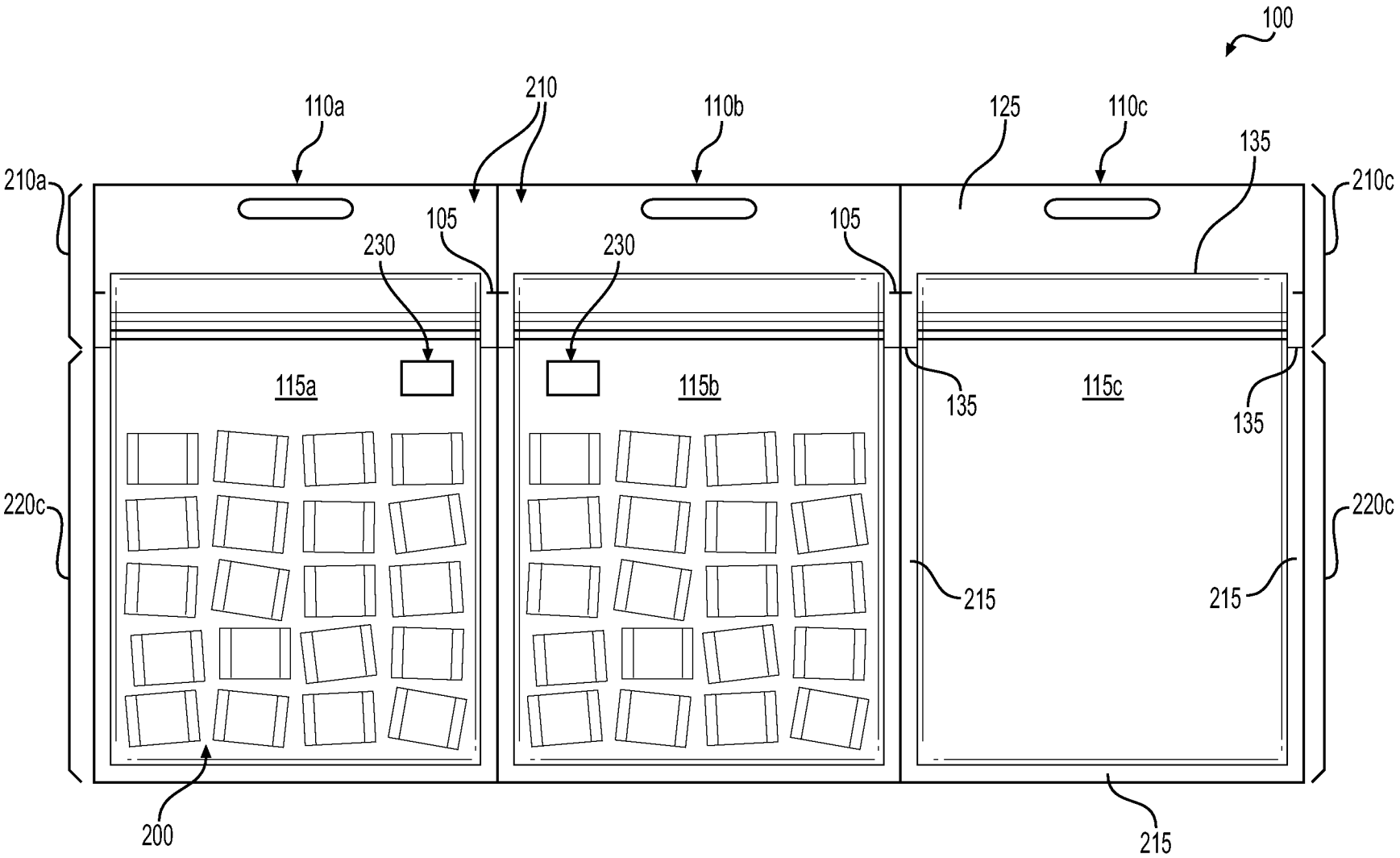
FIG. 2 is an illustration of an inner package containing a consumer product, in accordance with at least one example embodiment.

FIG. 2 is an illustration of the inner package 100 containing a consumer product 200, in accordance with an example embodiment.

In at least one example embodiment, the consumer product 200 includes an oral product. In at least one example embodiment, the consumer product 200 includes one or more pouches 205. In at least one example embodiment, the oral product is a tobacco product or a non-tobacco product. The oral product may include chewing tobacco, snus, moist snuff tobacco, dry snuff tobacco, or other smokeless tobacco and non-tobacco products for oral consumption. A smokeless tobacco product may include tobacco that is whole, shredded, cut, granulated, reconstituted, cured, aged, fermented, pasteurized, or otherwise processed. Tobacco may be present as portions of leaves, flowers, roots, stems, extracts, or any combination thereof. In at least one example embodiment, the oral product includes a tobacco extract, such as a tobacco-derived nicotine extract (e.g., white snus) alone or in combination with non-tobacco cellulosic materials (e.g., microcrystalline cellulose (MCC). Where the oral product includes nicotine, with or without tobacco, the nicotine may be tobacco-derived nicotine or synthetic nicotine. The oral product may be provided loose, in a pouch, as a plug or twist, or in a desired shape. The oral product may be in the form of lozenges, chews, gums, pouches, sticks, tablets, pastilles, or any other suitable form.

In at least one example embodiment, the oral product may have various ranges of moisture. In at least one example embodiment, the oral product is a dry oral product having a moisture content ranging from 5% by weight to 10% by weight. In at least one example embodiment, the oral product has a medium moisture content, such as a moisture content ranging from 20% by weight to 35% by weight. In at least one example embodiment, the oral product is a wet oral product having a moisture content ranging from 40% by weight to 55% by weight.

In at least one example embodiment, the one or more pouches 205 include smokeless tobacco pouches, for example. The non-tobacco products may include herbal compositions, pharmaceutical medications, or other non-tobacco products. Herbs and other edible plants can be categorized generally as culinary herbs (e.g., thyme, lavender, rosemary, coriander, dill, mint, peppermint) and medicinal herbs (e.g., Dahlias, Cinchona, Foxglove, Meadowsweet, *Echinacea*, Elderberry, Willow bark). In some example embodiments, the non-tobacco products may include *cannabis* or *cannabis* extracts.

In at least one example embodiment, one of the compartments 115 is left empty, and therefore does not include a consumer product. In at least one example embodiment, and as shown in FIG. 2, the third compartment 115*c* is left empty. In at least one example embodiment, the third compartment 115*c* can be used for spent (consumed) consumer products 15. In at least one example embodiment, the third panel 110*c* and the third compartment 115*c* are a same size as the first panel 110*a* and the first compartment 115*a*, and a same size as the second panel 110*b* and the second compartment 115*b*. In another example embodiment, the third panel 110*c* and the third compartment 115*c* are a different size relative to the other panels 110 and compartments 115. In at least one example embodiment, the third compartment 115*c*, which is left empty, is larger than the other compartments 115.

In at least one example embodiment, the first compartment 115*a* (first filled compartment) with the consumer product 200 can be opened, and the consumer product 200 can be consumed during a duration of time. Once the first compartment 115*a* is opened, the consumer product 200 is exposed to ambient air, where the ambient air can contribute to an increased rate of "flavor scalping" (loss of flavor quality) of the consumer product 200, due at least in part to oxygen degradation. In at least one example embodiment, the second compartment 115*b* (second filled compartment) can remain sealed until the consumer product 200 in the first compartment 115*a* is consumed, in order to maintain a freshness and reduce flavor scalping of the consumer product 200 in the second compartments 115*b*.

In at least one example embodiment, each of the compartments 115 includes a variety of different types and/or a differing amount of the consumer product 200. In at least one example embodiment, the variety of different types includes products with differing flavors, strengths, forms (solid, semi-solid, gel, etc.), or combinations thereof. In at least one example embodiment, each one of the compartments 115 includes a same one type of the consumer product 200, where each one of the compartments 115 contains a different type of the consumer product 200 and/or a different amount of the consumer product 200.

In at least one example embodiment, the inner package 100 includes one singular compartment containing the consumer product 200 (e.g., the first compartment 115*a*), where the one singular compartment is connected to one additional compartment which is left empty (e.g., the third compartment 115*c*). That is to say, in at least one example embodiment, the inner package 100 includes only two of the compartments 115. In another example embodiment, the inner package 100 includes a singular compartment containing the consumer product 200 (e.g., the first compartment 115*a*), where no other compartments are included in the inner package 100.

In at least one example embodiment, a quantity of the consumer product 200 within each of the compartments 115 is determined so as to mitigate or avoid flavor scalping. For instance, in at least one example embodiment, flavor scalping data in combination with an average consumption rate of the consumer product 200 can be used to determine a quantity of the consumer product 200 for each compartment 115.

In at least one example embodiment, a desiccant 230 can be included in the compartments 115 containing the consumer product 200 (e.g., compartments 115*a/b*), where the desiccant 230 can also be included in any of the other inner packages described herein. In at least one example embodiment, the desiccant 230 is a hygroscopic substance capable of removing moisture within the compartments 115. In at least one example embodiment, the desiccant 230 includes at least one of a silica gel, an activated charcoal, calcium sulfate, calcium chloride, a molecular sieve, or combinations thereof.

In at least one example embodiment, each panel 110 includes a heat sealed end 210, where a remainder 220*a* of each panel 110 is not heat sealed. In at least one example embodiment, a heat sealed end 210*c* (using the third panel 110*c* as an example) includes the heat sealed region 125, where a remainder 220*c* of the third panel 110*c* includes a non-heat sealed region 215. In this example embodiment, a portion of the border 135 of the heat sealed region 115 is below the tear-point 105.

Figure 3:
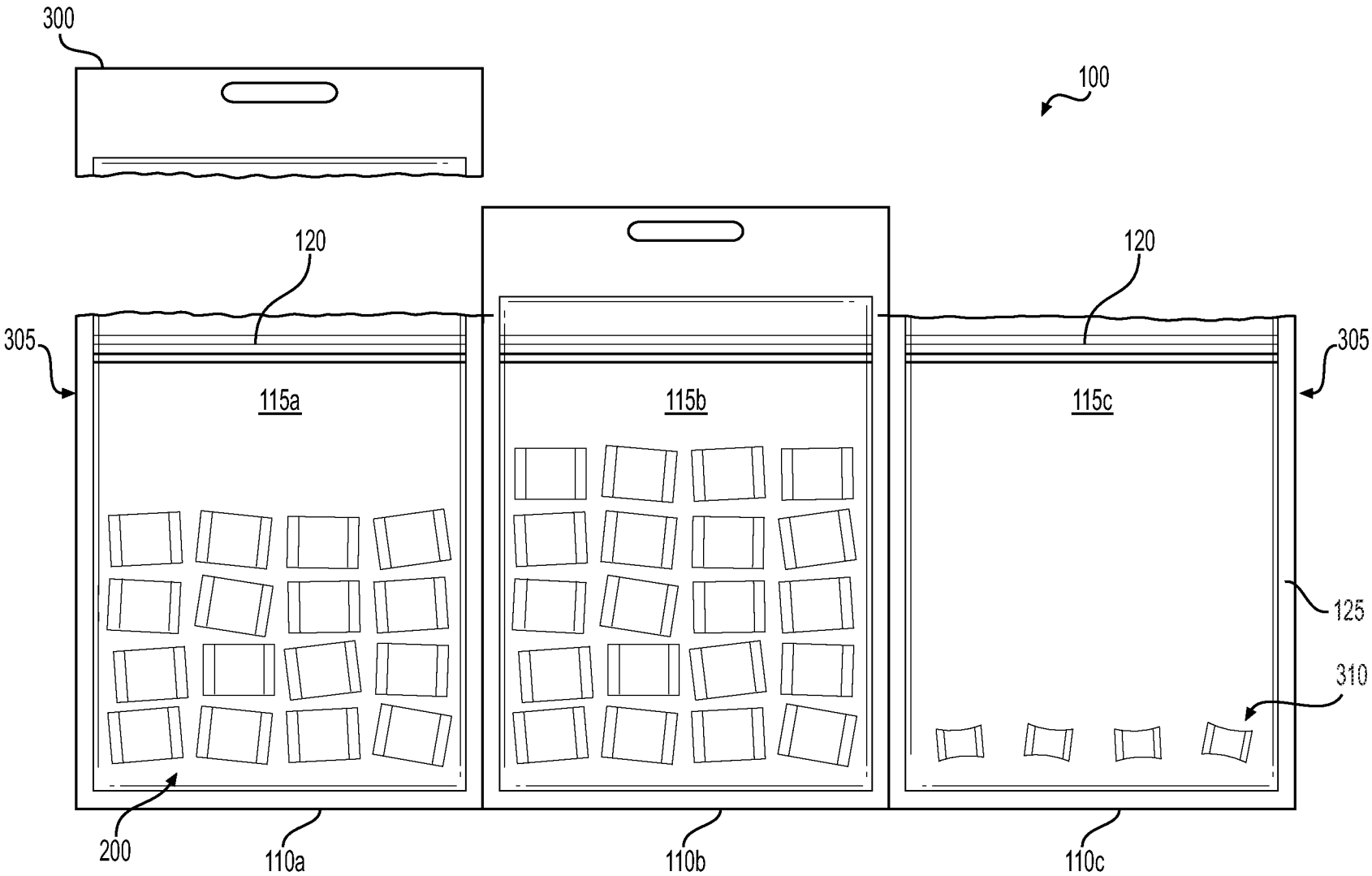
FIG. 3 is an illustration of an inner package with opened compartments, in accordance with at least one example embodiment.

FIG. 3 is an illustration of the inner package 100 with some of the compartments 115 in an opened configuration, in accordance with an example embodiment.

In at least one example embodiment, and as shown in FIG. 3, an end 300 of the first panel 110*a* is removed by tearing the end 300 from a remaining portion 305 of the first panel 110*a*, so that the re-closeable seal 120 is accessible and able to be opened and closed to access or seal the first compartment 115*a*.

In at least one example embodiment, both the first compartment 115*a* and the third compartment 115*c* are torn open, allowing the consumer product 200 to be consumed from the first compartment 115*a*. Following consumption, a spent (consumed) consumer product 310 can be discarded within the third compartment 115*c* or another one of the compartments 115 that is empty (also see FIG. 15J).

Figure 4:
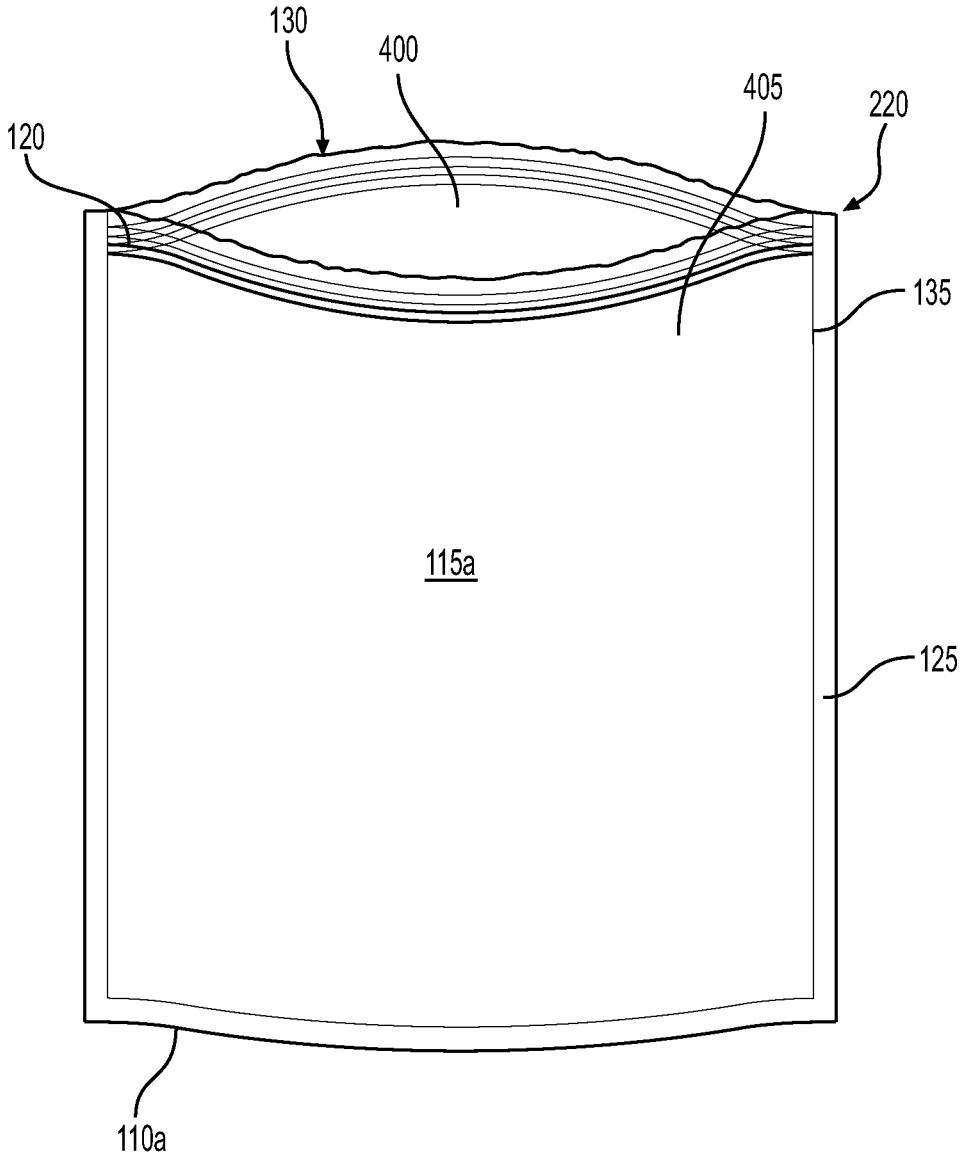
FIG. 4 is an illustration of an end of an opened compartment, in accordance with at least one example embodiment.

FIG. 4 is an illustration of the end 130 of the remainder 220 of the first panel 110*a*, after the end 300 has been removed, in accordance with an example embodiment.

In at least one example embodiment, the first panel 110*a* (and similarly, all the panels 110) are formed from a combination of a first sheet of material (first portion) 400 and a second sheet of material (second portion) 405. In at least one example embodiment, and as described in relation to FIGS. 15A-15G, the first sheet of material 400 and the second sheet of material 405 can be joined at least in part by the heat sealed region 125. In another example embodiment, the first sheet of material 400 and the second sheet of material 405 can be extruded or blown so that the sheets of material 400/405 are, in essence, one sheet of material with no seams. In at least one example embodiment, the sheets of material 400/405 are joined at edges by other means, besides heat sealing, or in addition to heat sealing. In at least one example embodiment, the other means of joining the sheets of material 400/405 include the use of an adhesive, stitching, folding, spot heat sealing (in combination or in lieu of heat sealed seams), application of a solvent causing the sheets of material 400/405 to partially dissolve and re-solidify to be joined at edges, etc. Other means of joining the sheets of material 400/405 are also contemplated.

Figure 5:
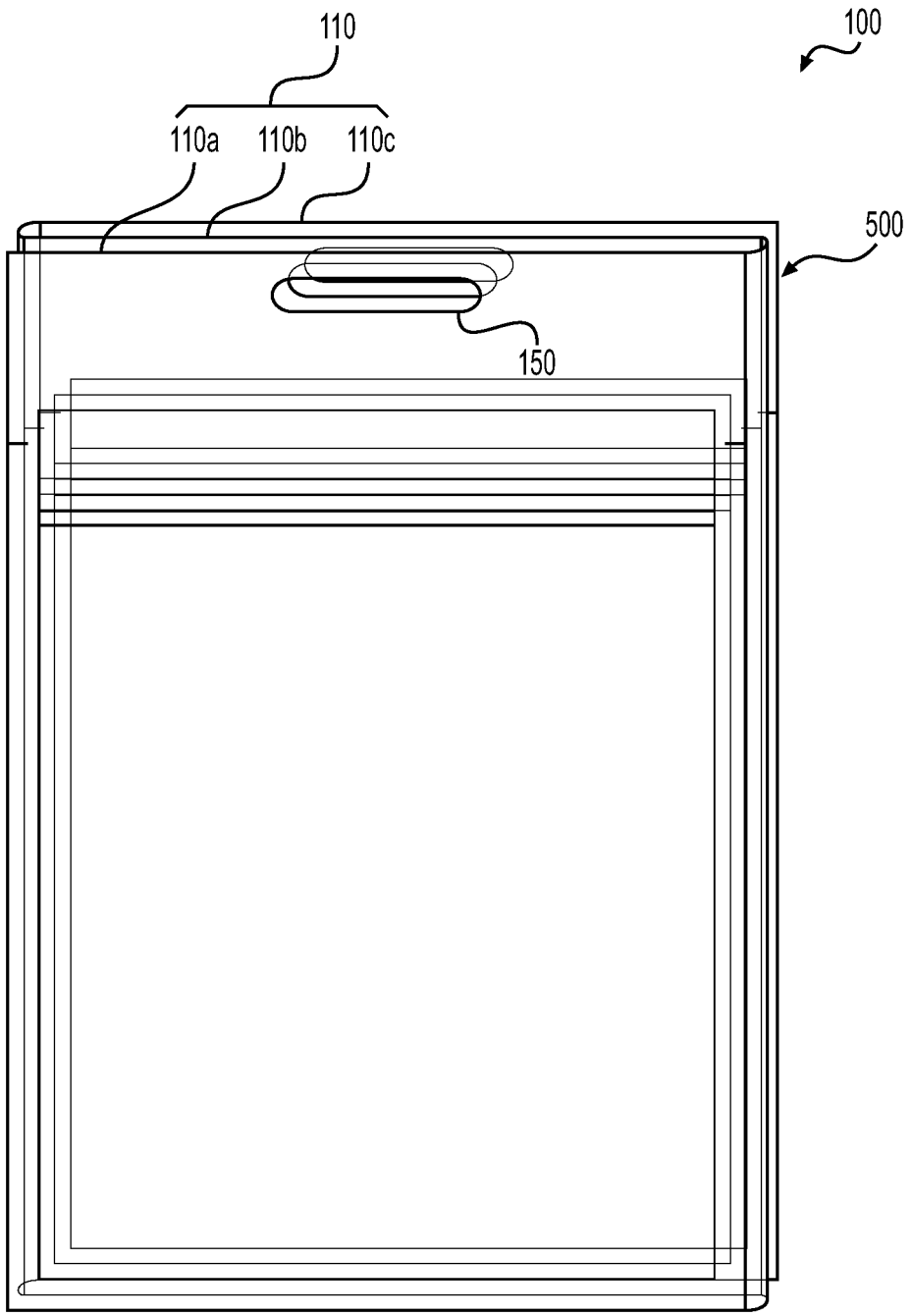
FIG. 5 is an illustration of an inner package in a folded configuration, in accordance with at least one example embodiment.

FIG. 5 is an illustration of the inner package 100 in a folded configuration 500, in accordance with an example embodiment.

In at least one example embodiment, the panels 110 are folded on top of each other, to lay flat or substantially flat on each other. In at least one example embodiment, the folded configuration 500 can be considered an "accordion-style configuration" or an "accordion configuration" (see the example of folding in FIG. 15H), as the panels 110 are folded onto each other.

In at least one example embodiment, the folded configuration 500 has a footprint (as depicted in FIG. 5) that is substantially a size of one of the panels 110.

In at least one example embodiment, in the folded configuration 500, the slit 150 of the panels 110 are able to align, allowing the inner package 100 to be hung.

Figure 6:
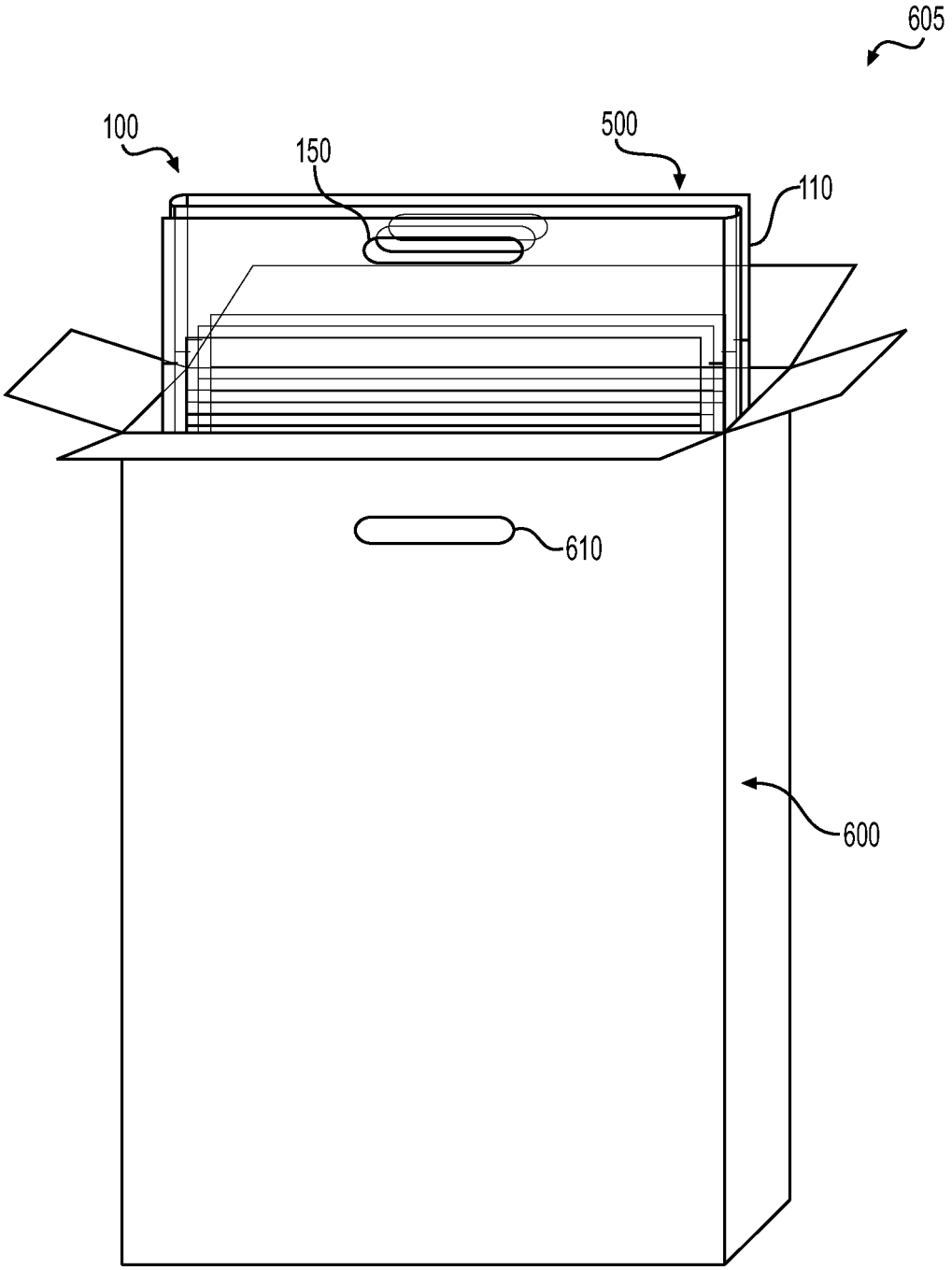
FIG. 6 is an illustration of an inner package being placed into an outer package, in accordance with at least one example embodiment.

FIG. 6 is an illustration of the inner package 100 being placed into an outer package 600 to form a package 605, in accordance with an example embodiment.

In at least one example embodiment, the inner package 100 is folded into the folded configuration 500, prior to the inner package 100 being slid into an open end of the outer package 600.

In at least one example embodiment, the inner package 100 is placed into the outer package 600, where the slit 150 of each of the panels 110 aligns with a slit 610 in the outer package 600.

Figure 8:
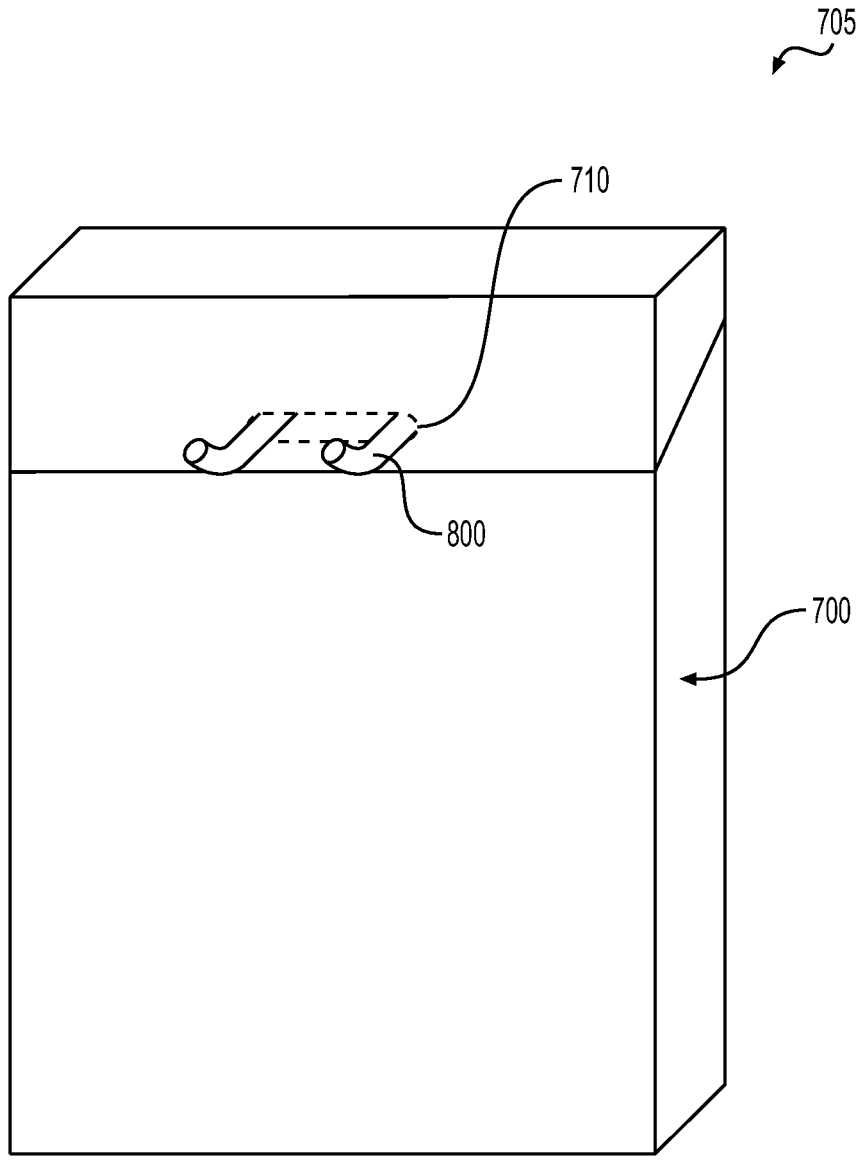
FIG. 8 is an illustration of a package in a sealed configuration, in accordance with at least one example embodiment.

In this example embodiment, the outer package 600 and the inner package 100 are able to be hung on the hanger 800 (see FIG. 8).

Figure 7:
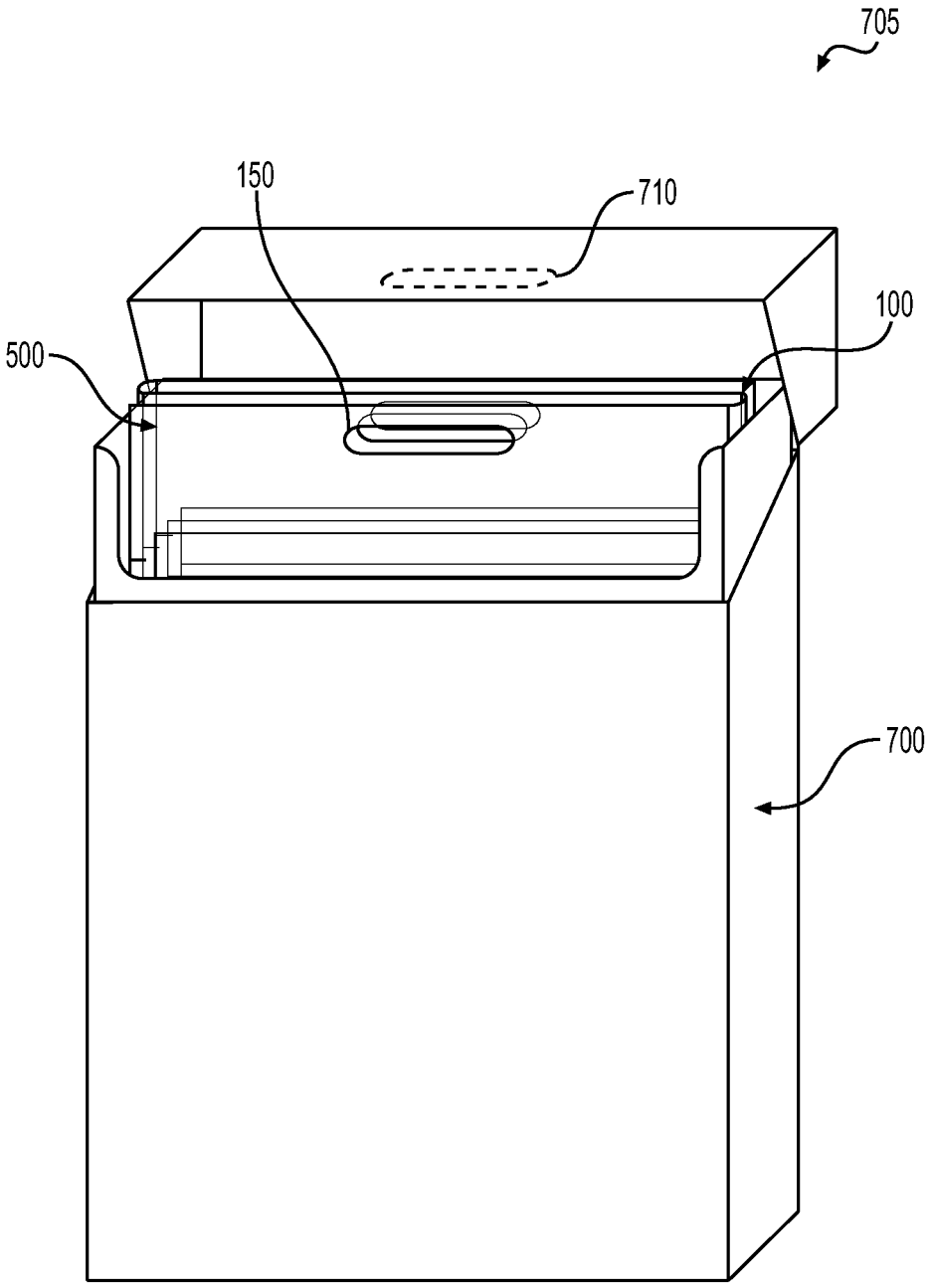
FIG. 7 is an illustration of an inner package being placed into another outer package, in accordance with at least one example embodiment.

FIG. 7 is an illustration of the inner package 100 in the folded configuration 500 being placed into another outer package 700 to form a package 705, in accordance with an example embodiment.

In at least one example embodiment, the outer package 700 has a slit 710 that is able to be aligned with the slit 150 of the inner package 100.

FIG. 8 is an illustration of a front of the package 705 in a sealed (assembled) configuration, in accordance with an example embodiment.

In at least one example embodiment, and as shown in FIG. 8, the package 705 can be hung on the hanger 800. In at least one example embodiment, the hanger 800 traverses through the slit 710 of the outer package 700 and the slit 150 of the inner package 100 to allow the package 705 to be hung. In another example embodiment, the hanger 800 traverses through the outer package 700 but does not traverse through the inner package 100. In this example embodiment, the slit 150 in the inner package 100 (see FIG. 5) may not be included.

Figure 9:
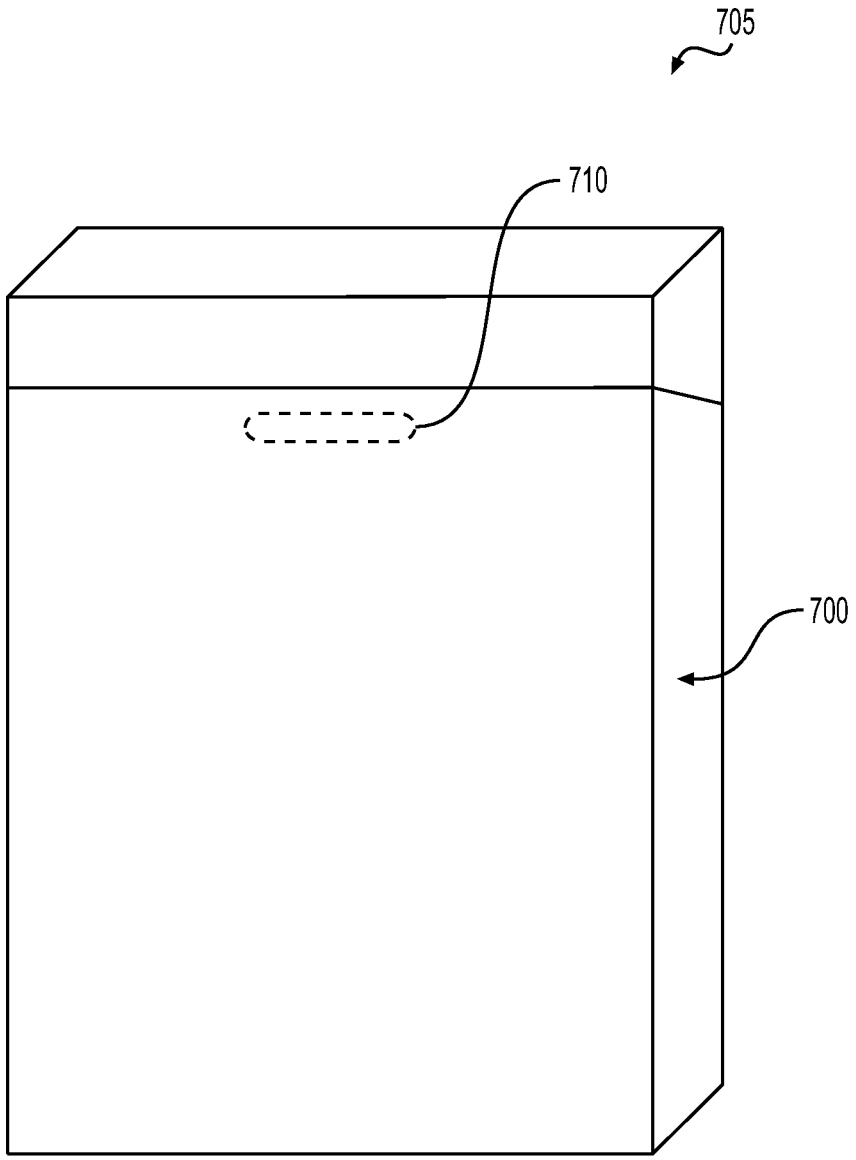
FIG. 9 is an illustration of the package of FIG. 8 in the sealed configuration, in accordance with at least one example embodiment.

FIG. 9 is an illustration of a back of the package 705 of FIG. 8 in the sealed (assembled) configuration, in accordance with an example embodiment.

In at least one example embodiment, the slit 710 traverses through the front and back of the package 705, as shown in FIGS. 8 and 9.

Figure 10:
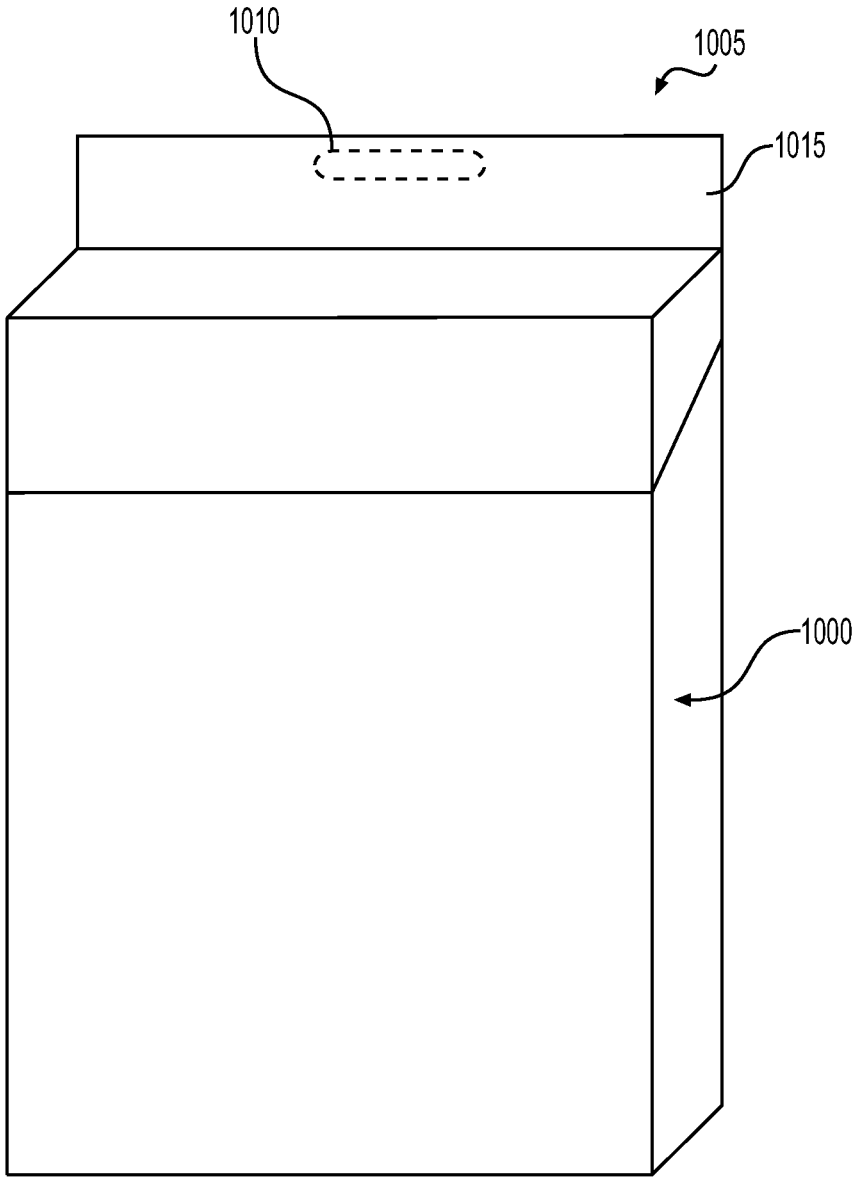
FIG. 10 is an illustration of another outer package in a sealed configuration, in accordance with at least one example embodiment.

FIG. 10 is an illustration of another package 1005, in accordance with an example embodiment.

In at least one example embodiment, the package 1005 includes an outer package 1000 with a tab 1015. In at least one example embodiment, the tab 1015 includes a slit 1010. In at least one example embodiment, the slit 1010 is used to hang the package 1005.

In at least one example embodiment, the outer packages (e.g., 600, 700, and 1000) are made from cardboard, paperboard, paper, or combinations thereof. In at least one example embodiment, the outer packages are made from a recyclable material. In at least one example embodiment, the outer packages are made from a same material as the inner packages.

Figure 11:
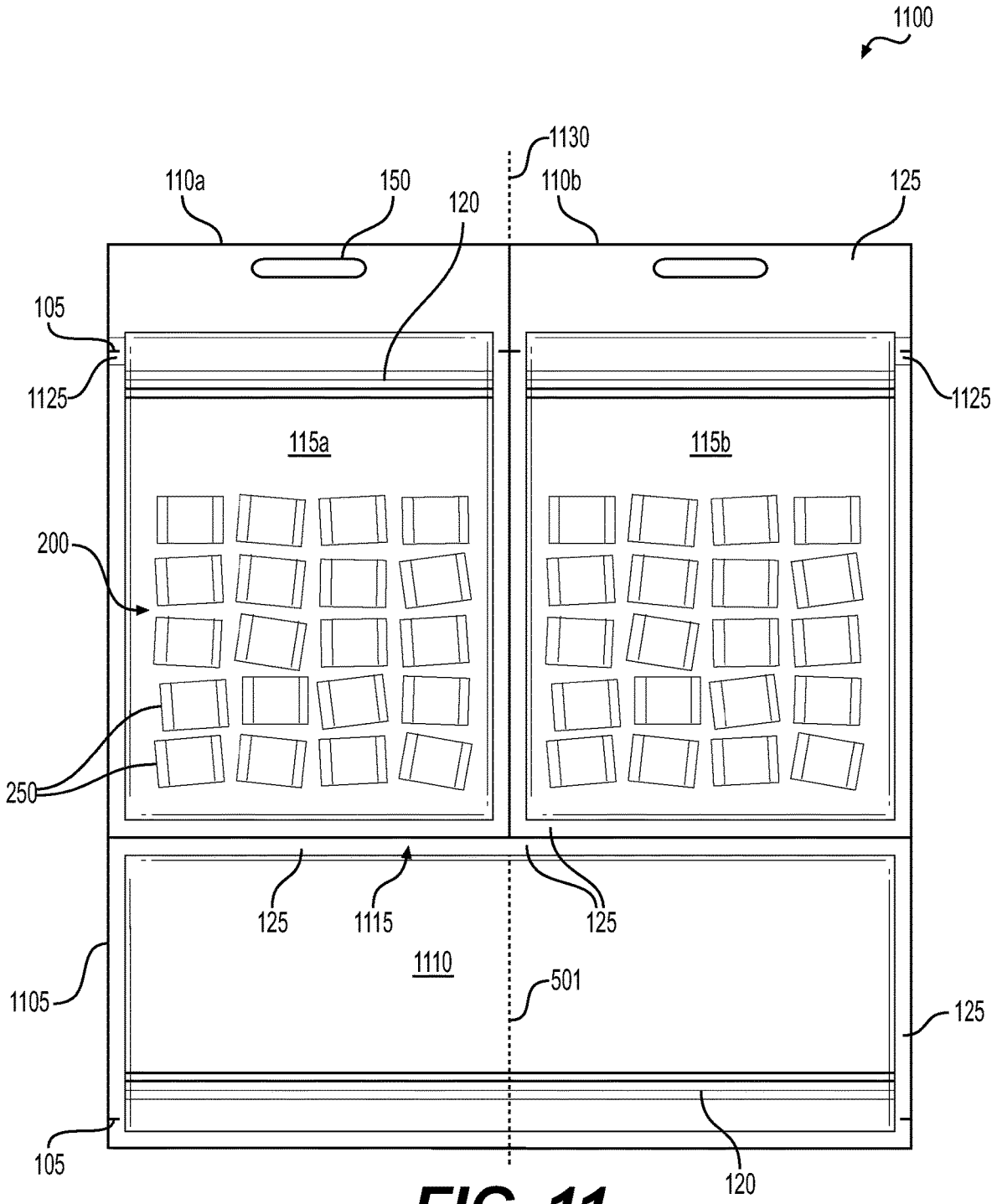
FIG. 11 is an illustration of another inner package, in accordance with at least one example embodiment.

FIG. 11 is an illustration of another inner package 1100, in accordance with an example embodiment.

In at least one example embodiment, the inner package 1100 includes panels 110 in a side-by-side configuration, where the panels 110 are also in an end-to-end configuration with a third panel 1105 connected at a bottom of the inner package 1100. Specifically, in at least one example embodiment, the inner package 1100 includes a first panel 110*a* with a first compartment 115*a* and a second panel 110*b* with a second compartment 115*b*, where the third panel 1105 includes a third compartment 1110. In at least one example embodiment, an interfacing end edge 1115 of the third panel 1105 is connected to interfacing end edges 1120 of the first panel 110*a* and the second panel 110*b*. In at least one example embodiment, the third panel 1105 and the third compartment 1110 are a different size relative to the panels 110 and compartments 115. In at least one example embodiment, the third panel 1105 runs along a width of the panels 110, where the third panel 1105 is connected to a lower interfacing edge of the panels 110.

In at least one example embodiment, at least one of the compartments 115/1110 of the inner package 1100 is left empty, and therefore does not include a consumer product 200. In at least one example embodiment, the third compartment 1110 is left empty.

In at least one example embodiment, the third compartment 1110 is larger (a greater volume), as compared to the other compartments 115.

In at least one example embodiment, each of the panels 110/1105 includes the tear-point 105. In at least one example embodiment, and as shown in FIG. 11, some or all of the tear-points 105 may include a thinned area 1125 that assists in tearing open at least some of the panels 110/1105 to access the re-closeable seal 120 and a respective one of the compartments 115/1110.

In at least one example embodiment, the slit 150 is included near the upper end of the inner package 1100. In at least one example embodiment, the inner package 1100 is able to be folded along fold line 1130, so that the first panel 110*a* and the second panel 110*b* are folded on top of each other, and the third panel 1105 is folded along a mid-section of the third panel 1105.

Figure 12:
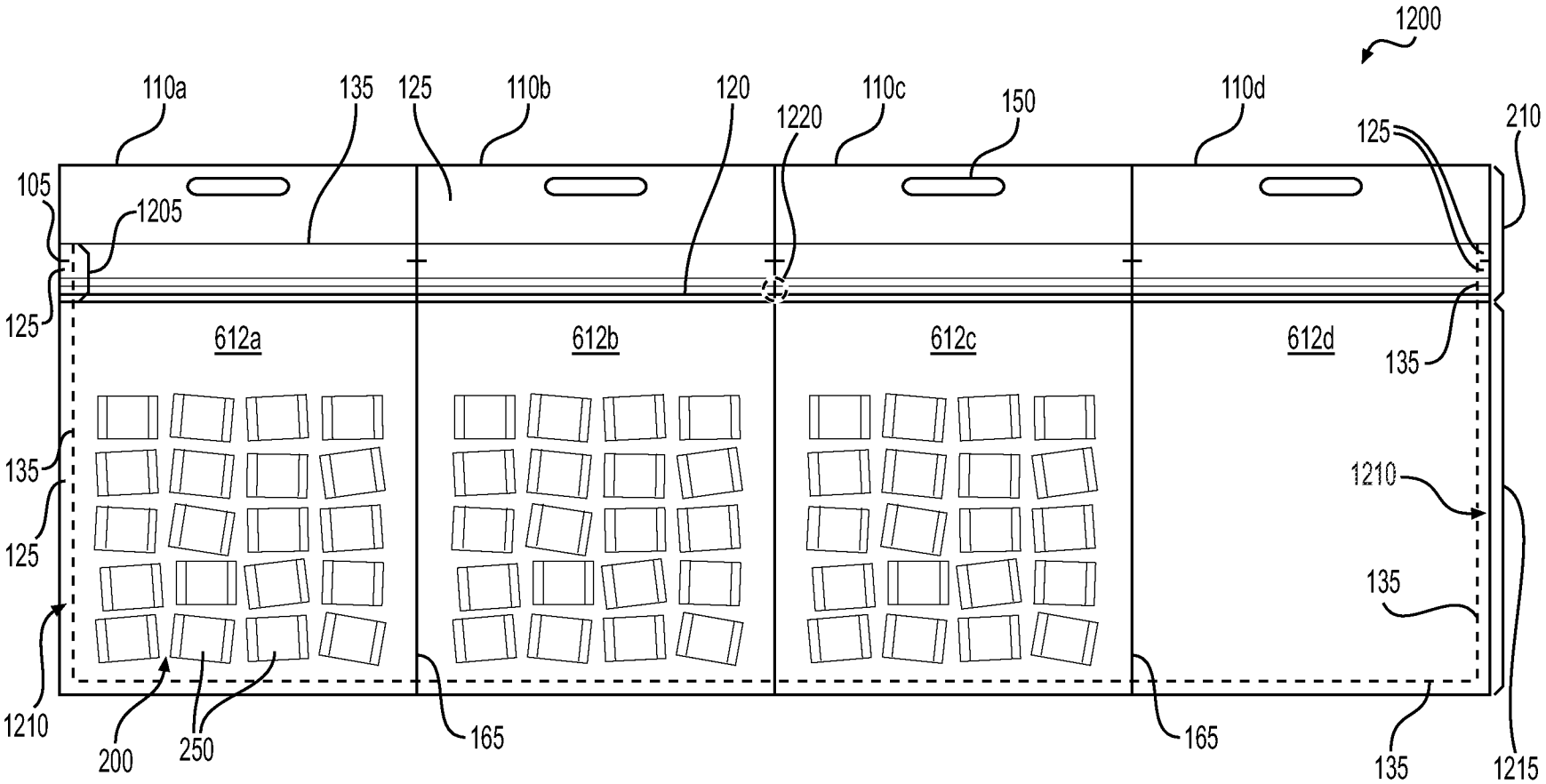
FIG. 12 is an illustration of another inner package, in accordance with at least one example embodiment.

FIG. 12 is an illustration of another inner package 1200, in accordance with an example embodiment.

In at least one example embodiment, the inner package 1200 includes panels 110 that number four or more. In at least one example embodiment, the inner package 1200 includes a fourth panel 110*d* with a fourth compartment 115*d* that is left empty, such that the empty compartment 115*d* does not include a consumer product 200. In at least one example embodiment, the fourth compartment 115*d* is a same size as the other compartments (115*a-c*). In at least one example embodiment, the fourth compartment 115*d* is a different size relative to the other compartments (115*a-c*). In at least one example embodiment, the fourth compartment 115*d* is a larger size (more volume), as compared to the other compartments (115*a-c*).

In at least one example embodiment, some or all of the panels 110 include the heat sealed end 210. In at least one example embodiment, a first portion 1205 of a border of the inner package 1200, near the tear-points 105 on side edges of the inner package 1200, can include the heat sealed regions 125. In at least one example embodiment, the first portion 1205 is not heat sealed. In at least one example embodiment, a second portion 1210 of an outer border around outer edges of the compartments 115, that is on a lower portion 1215 of the inner package 1200, includes the heat sealed regions 125. In at least one example embodiment, the second portion 1210 is not heat sealed. In at least one example embodiment, the divider 614 is a seam that joins the first sheet of material 400 and the second sheet of material 405 (FIGS. 4 and 15A) to form each of the panels 110. In another example embodiment, the divider 165 is a seam that is formed during an extrusion or a blowing process. In at least one example embodiment, the divider 165 is bracketed by a heat sealed region. In at least one example embodiment, the divider 165 is a heat sealed region. It should be understood that, if the divider 165 is formed via heat sealing, any heat sealed portions 1220 of the divider 165 that traverse through the re-closeable seal 120 will cause the re-closeable seal 120 to become non-functional in the heat sealed portions 1220. That is to say, the heat sealed portions 1220 will cause the re-closeable seal 120 to remain closed in these locations, such that the re-closeable seal 120 will be unable to be opened and re-closed in the heat sealed portions 1220.

Figure 13:
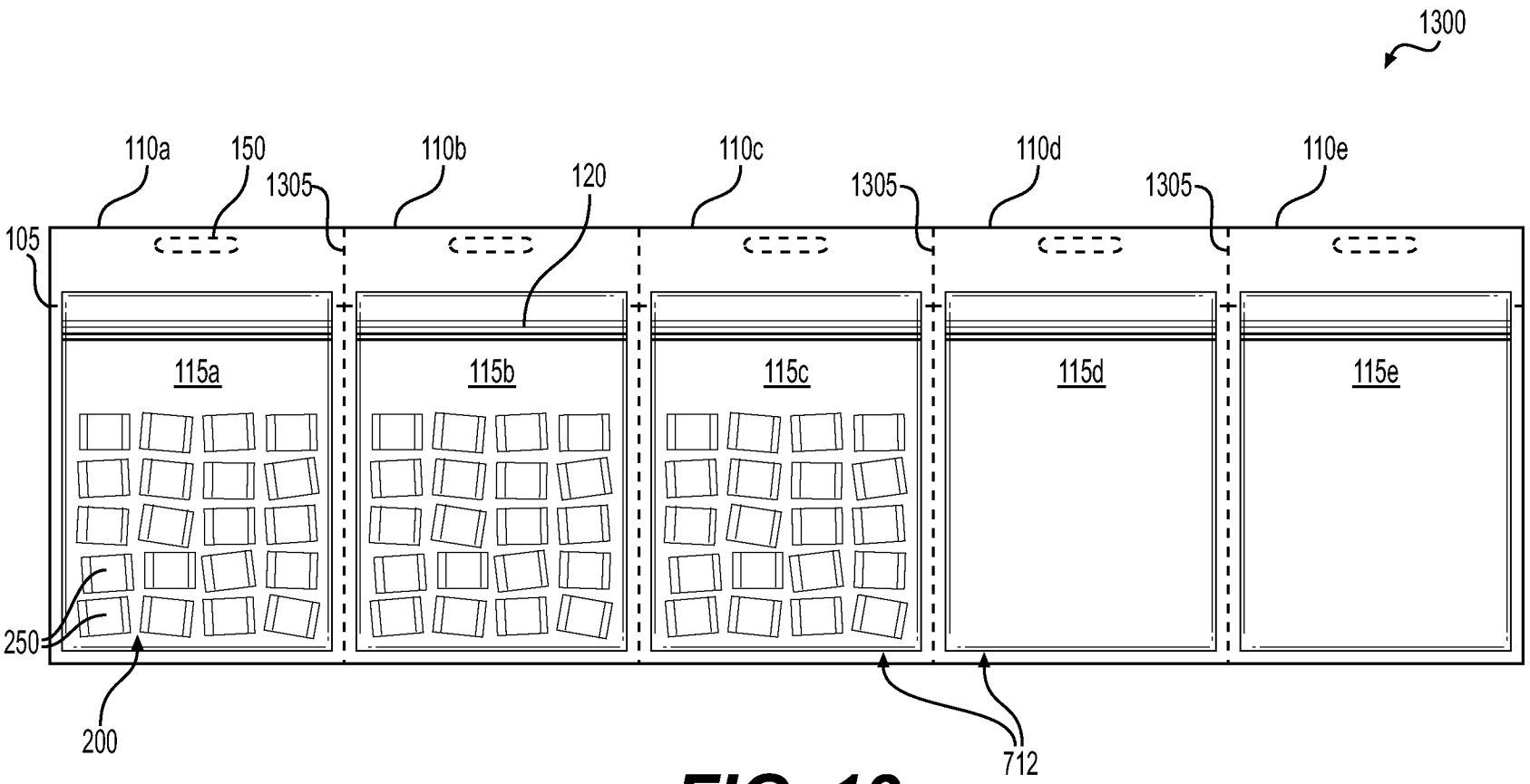
FIG. 13 is an illustration of another inner package, in accordance with at least one example embodiment.

FIG. 13 is an illustration of another inner package 1300, in accordance with an example embodiment.

In at least one example embodiment, the inner package 1300 includes five or more panels 110. In at least one example embodiment, at least two of the compartments 115 are left empty, and therefore do not contain a consumer product 200. In at least one example embodiment, the inner package 1300 includes the fourth panel 110*d* with the fourth compartment 115*d* and a fifth panel 110*e* with a fifth compartment 115*e*, where these two compartments 115*d*/115*e* are left empty.

In at least one example embodiment, a number of the compartments that are left empty equal a number of the compartments that contain the consumer product 200. In another example embodiment, a number of the compartments that are left empty are less than a number of the compartments that contain the consumer product 200.

In at least one example embodiment, some or all of the interfacing edges between the panels 110 include a divider 1305 that defines a tear-line. In at least one example embodiment, the divider 1305 is a perforated or weakened line that allows some or all of the panels 110 to be torn away from a remainder of the inner package 1300 (see FIG. 15K, as an example). In at least one example embodiment, only the dividers 1305 between the fourth panel 110*d* and the fifth panel 110*e* define a tear-line, thereby only allowing the fifth panel 110*e* to be torn away from the inner package 1300, whereas the remaining dividers 1305 are embossed lines or fold lines, that may or may not be bracketed or formed by heat sealing. In at least one example embodiment, each of the dividers 1305, other than the divider 1305 between the third panel 110*c* and the fourth panel 110*d*, define a tear-line. In this example embodiment, the third panel 110*c* and the fourth panel 110*d* are configured to remain together, up to a point in time when the inner package 1300 is to be disposed of following use of the inner package 1300.

Figure 14:
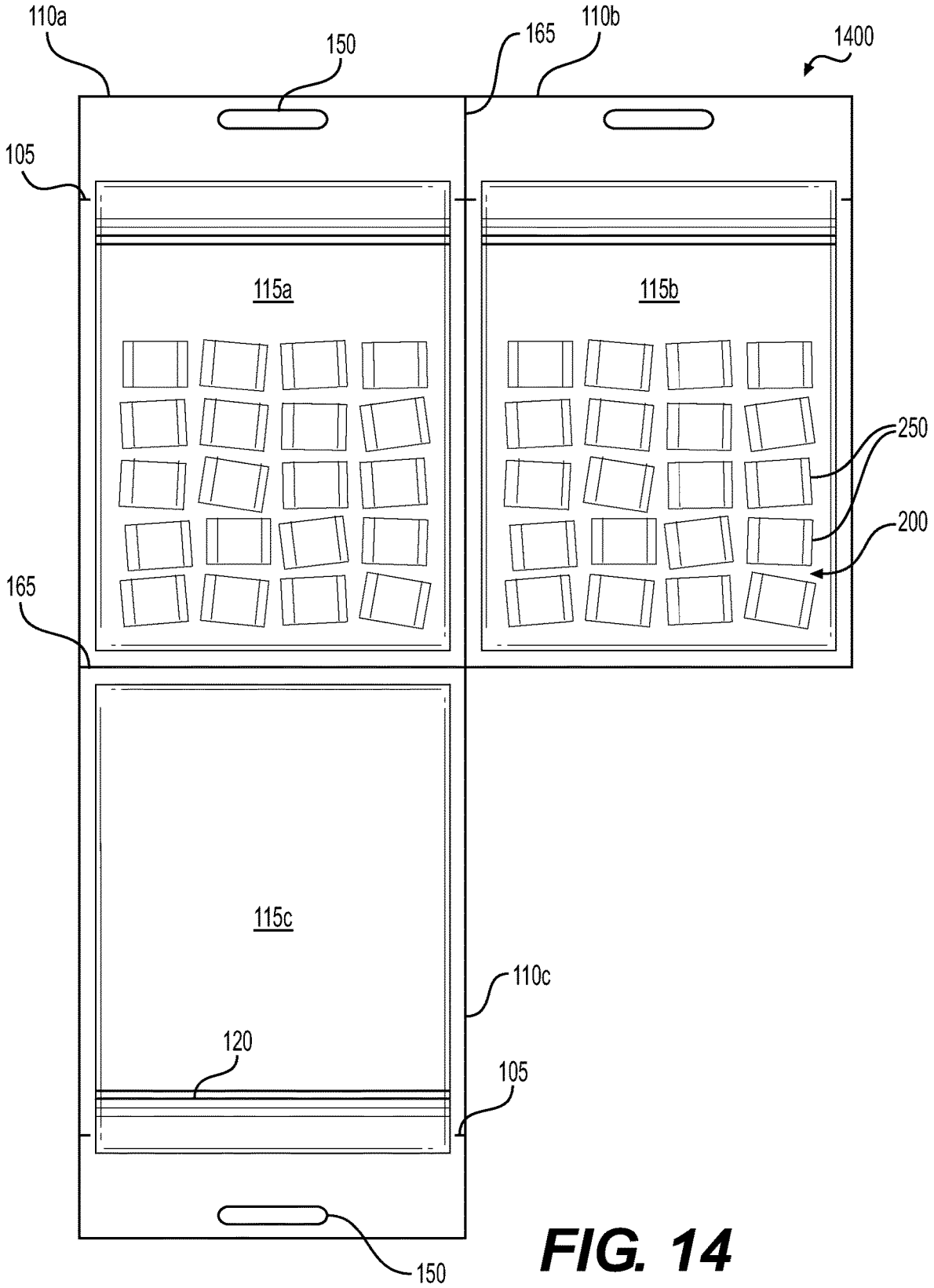
FIG. 14 is an illustration of another inner package, in accordance with at least one example embodiment.

FIG. 14 is an illustration of another inner package 1400, in accordance with an example embodiment.

In at least one example embodiment, the inner package 1400 includes panels 110 in both a side-by-side and end-to-end configuration. In at least one example embodiment, the inner package 1400 includes the third panel 110*c* in end-to-end configuration with only one other panel, such as the first panel 110*a*.

In at least one example embodiment, the third compartment 115*c* is left empty, such that the third compartment 115*c* does not contain the consumer product 200. In at least one example embodiment, more than one of the compartment 115 is left empty.

In at least one example embodiment, the inner package 1400 includes panels 110 that are only in the end-to-end configuration. For instance, in at least one example embodiment, the inner package 1400 includes the first panel 110*a* and the third panel 110*c*, and not the second panel 110*b*.

In at least one example embodiment, the slit 150 is included on a lower end of the third panel 110*c*. In at least one example embodiment, the slits 150 each become aligned once the inner package 1400 is folded into a folded configuration. In at least one example embodiment, in order to fold the inner package 1400 into the folded configuration, the first panel 110*a* and the second panel 110*b* are folded over each other, and the third panel 110*c* is folded up to also be folded on top of the first panel 110*a* and the second panel 110*b*.

Figure 15A:
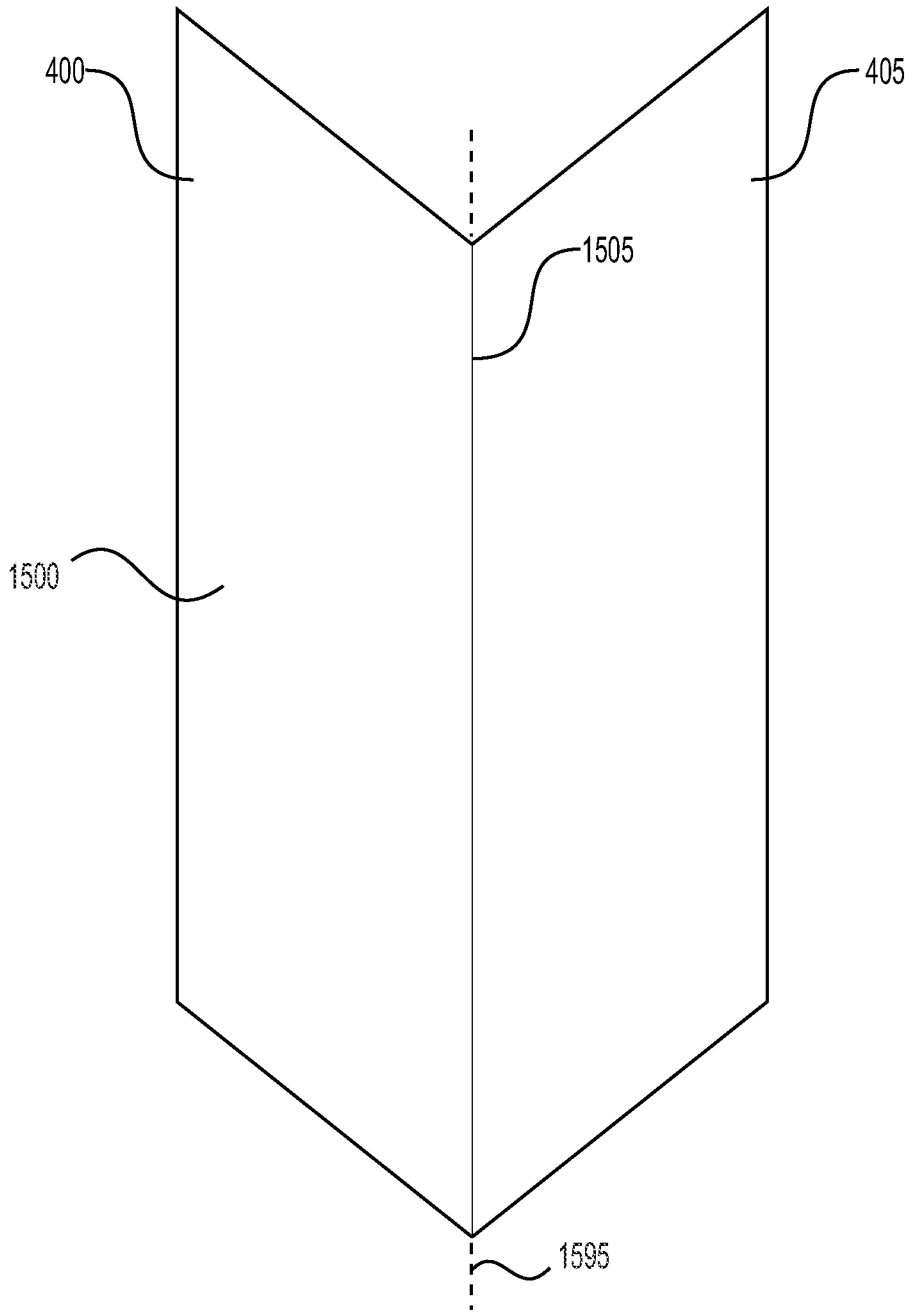
FIG. 15A is an illustration of a layer of material for forming an inner package, in accordance with at least one example embodiment.
Figure 15B:
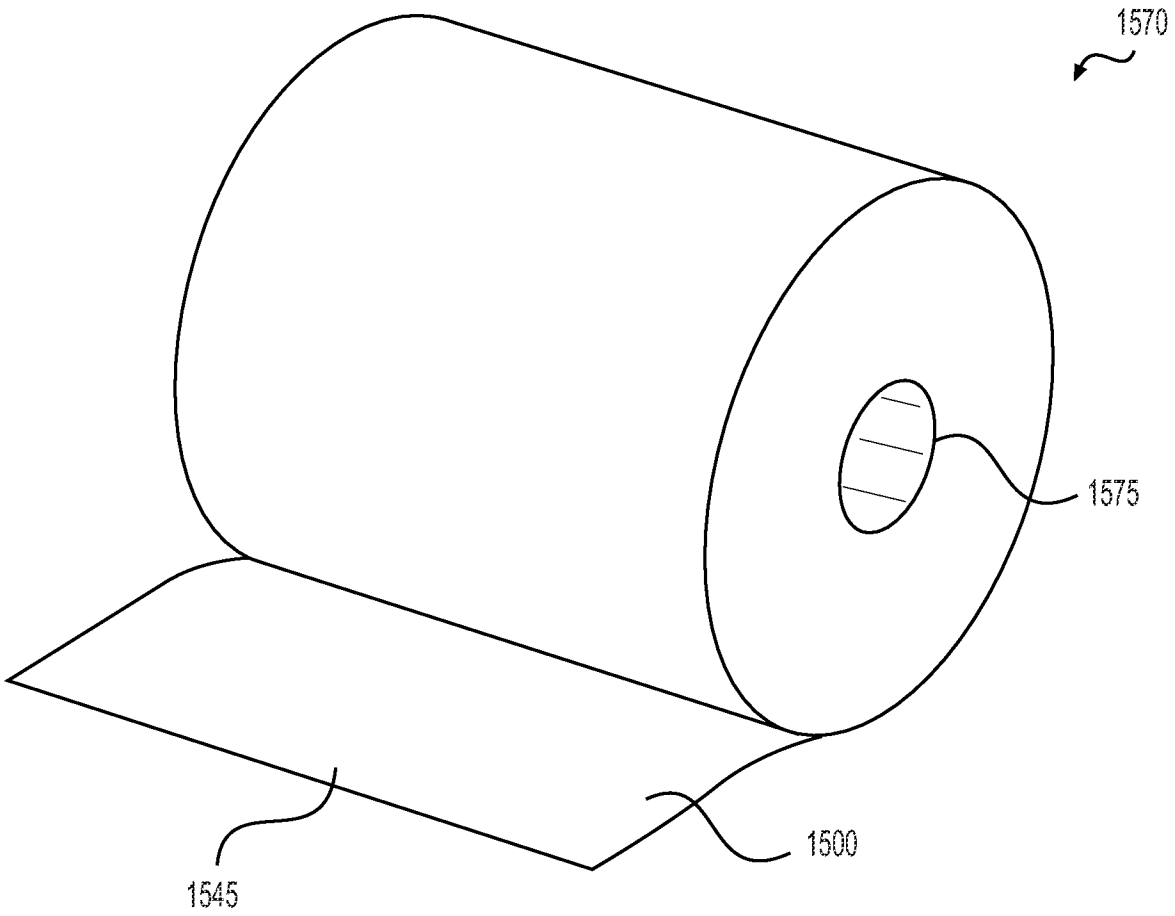
FIG. 15B is an illustration of a spool of a layer of material, in accordance with at least one example embodiment.
Figure 15C:
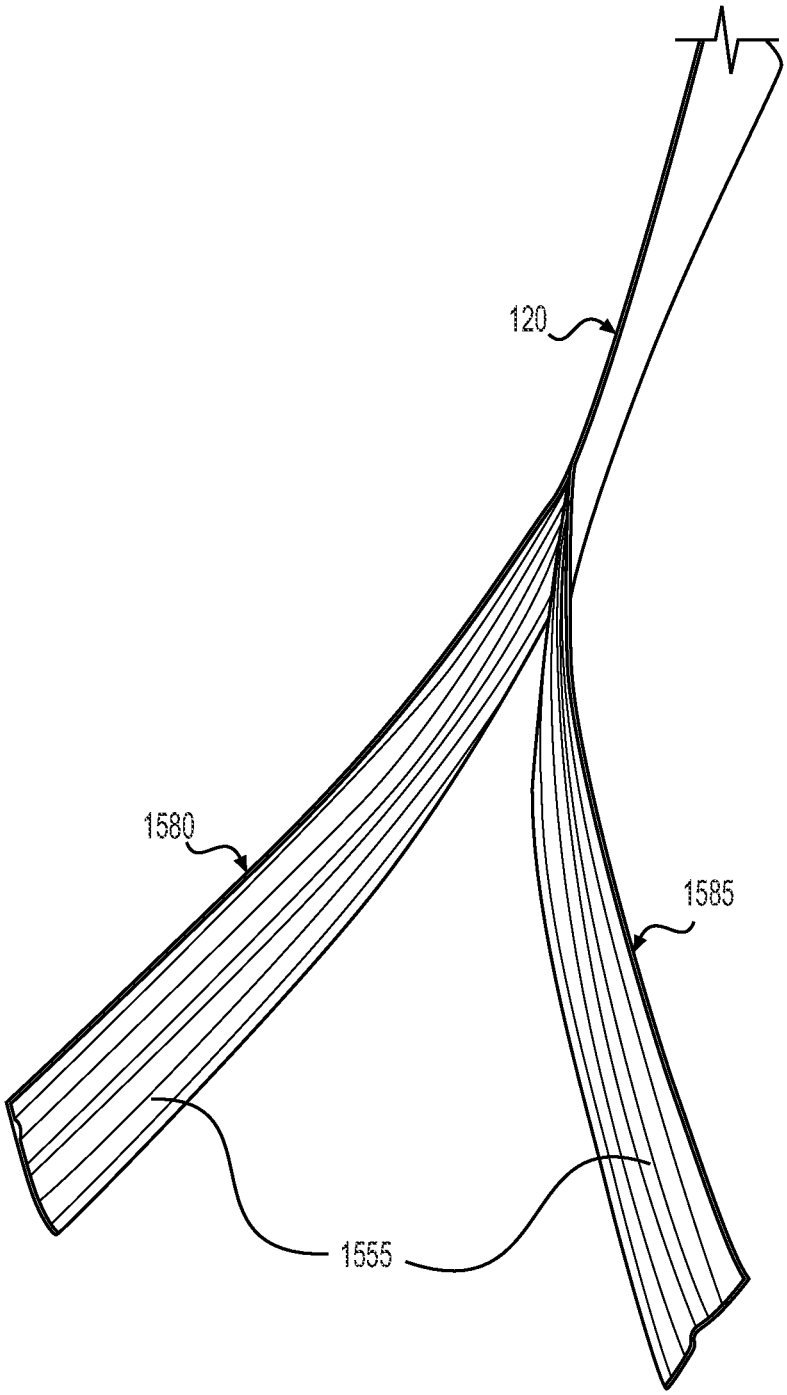
FIG. 15C is an illustration of a re-closeable seal for an inner package, in accordance with at least one example embodiment.

FIG. 15A is an illustration of a layer of material 1500 for forming an inner package, in accordance with an example embodiment. FIG. 15B is an illustration of a spool 1570 of the layer of material 1500, in accordance with at least one example embodiment. FIG. 15C is an illustration of the re-closeable seal 120 for an inner package, in accordance with at least one example embodiment.

In at least one example embodiment, the layer of material 1500 is one single sheet that is folded down a fold line 1505, so that the first sheet of material 400 and the second sheet of material 405 are one single sheet that is divided by the fold line 1505. In at least one example embodiment, the fold line 1505 corresponds with a centerline 1595 that runs along a longitudinal length of the layer of material 1500. In another example embodiment, the sheet of material 1500 is more than one sheet. In at least one example embodiment, the first sheet of material 400 is separate from the second sheet of material 405, where the fold line 1505 is a seam that joins the first sheet of material 400 and the second sheet of material 405 to form the sheet of material 1500. In at least one example embodiment, the fold line 1505 is a heat sealed line. In at least one example embodiment, the first sheet of material 400 and the second sheet of material 405 can be joined via an adhesive, stitching, folding, or by other means, in addition to or alternatively from heat sealing.

In at least one example embodiment, the layer of material 1500 includes one or more pliable layers of material with an efficient water/vapor transmission rate that provides a barrier to protect against flavor scalping of the consumer product 200, especially following an exposure of the consumer product to ambient air. In at least one example embodiment, a pliable nature of the layer of material 1500, where the layer of material 1500 is capable of heat sealing and/or crimping, can ease manufacturing adjustments. For example, potential changes to a head-space (internal volume) within the compartments 115 (FIG. 15G) can be adjusted by cutting and forming different sizes of the layer of material 1500, where the use of heat sealing/crimping can further fine-tune (minimize) the head-space. In at least one example embodiment, the cutting and forming of the layer of material 1500, and the heat-sealing and/or crimping of the layer of material 1500, is accomplished to minimize the head-space in order to reduce oxygen and/or moisture exposure for the consumer product 200 in each of the compartments 115. In at least one example embodiment, the layer of material 1500 can be used in bulk quantities and cut to needed sizes that may vary for an array of inner packages, where heating sealing and/or crimping can further adjust a size of the compartments 115 (FIG. 15G). In at least one example embodiment, adjusting for a desired head-space to contain the consumer product 200 within the compartments 115 can, by itself, assist in maintaining freshness of the consumer product 200. In at least one example embodiment, use of the layer of material 1500 can assist manufacturing efforts by being easy to work with in terms of being able to use vertical form, fill and seal (VFFS) machines that are able to quickly form and fill the inner packages made from the layer of material 1500.

As shown in FIG. 15B, and in at least one example embodiment, the layer of material 1500 can be wound around a mandrel 1575 to make the spool 1570. In at least one example embodiment, an end 1545 of the layer of material 1500 can be pulled or unwound from the spool 1570, prior to folding of the layer of material 1500 along the fold line 1505 (FIG. 15A). In at least one example embodiment, the re-closeable seal 120 can be formed from a first strip 1580 and a second strip 1585 of material, where the first strip 1580 and the second strip 1585 define interlocking grooves 1555 (FIG. 15C). In at least one example embodiment, the first strip 1580 and the second strip 1585 can be made from a same material as the layer of material 1500.

Figure 15D:
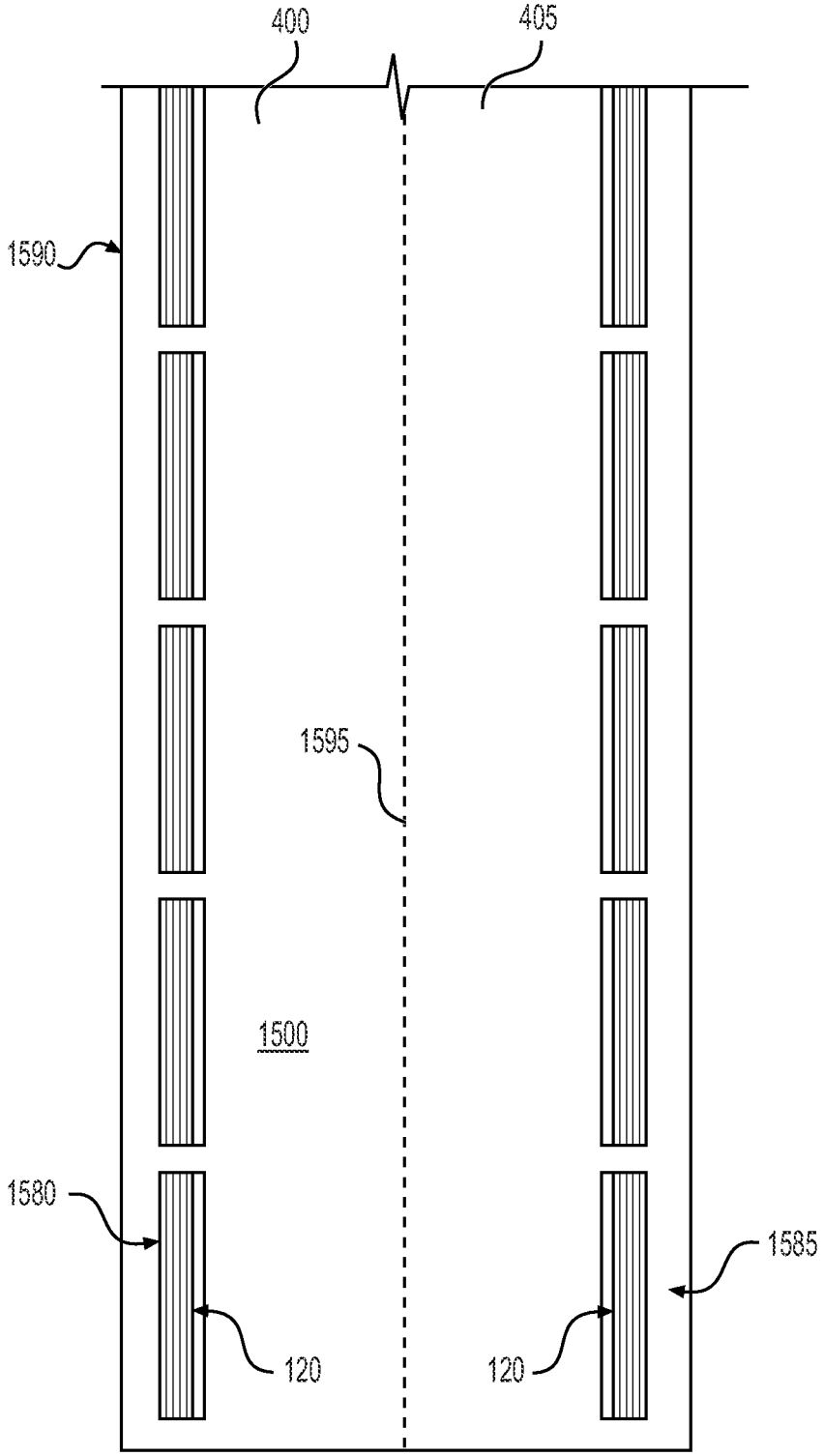
FIG. 15D is an illustration of a layer of material with portions of re-closeable seals connected to the layer of material, in accordance with at least one example embodiment.
Figure 15E:
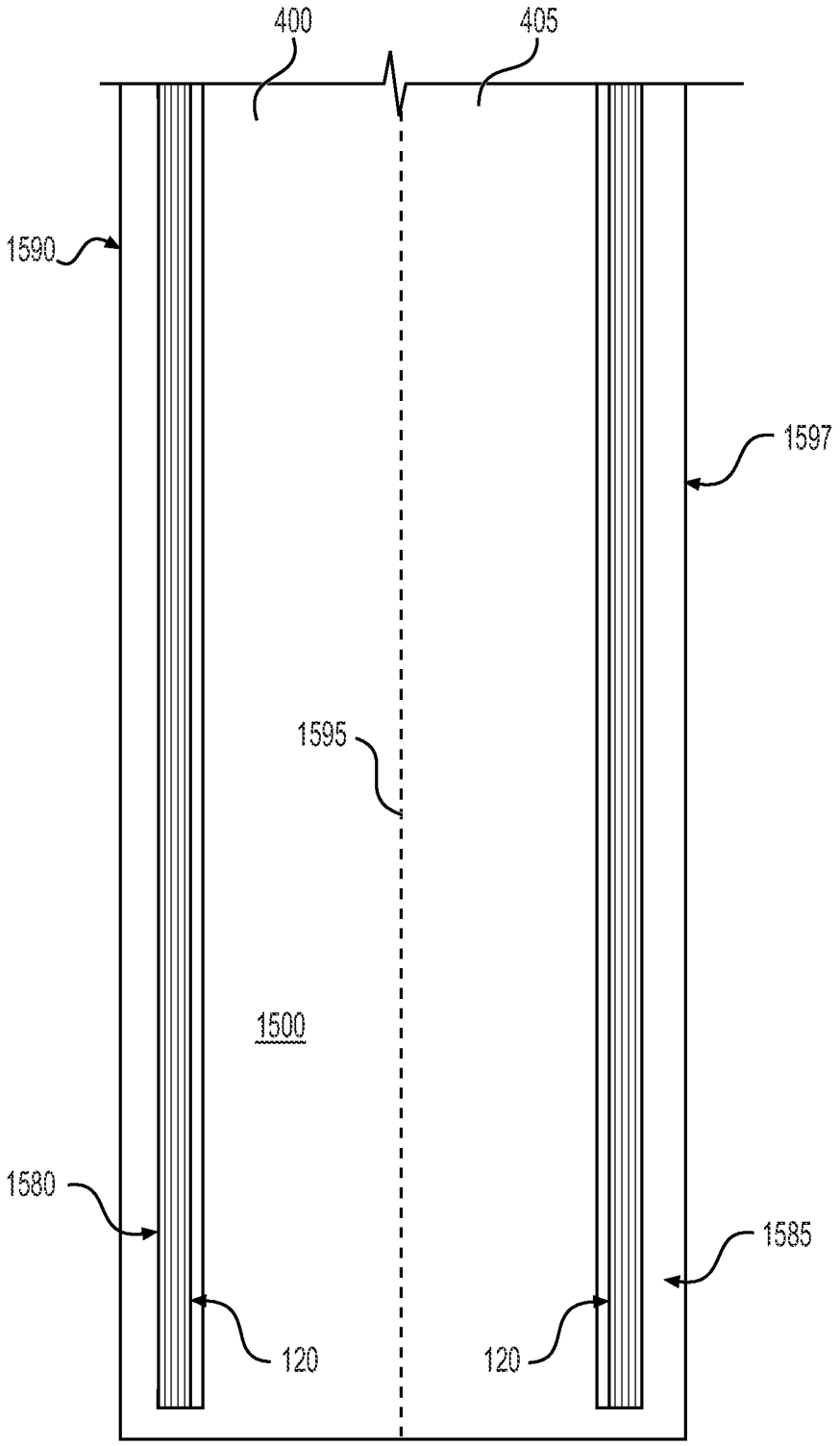
FIG. 15E is an illustration of a layer of material with portions of re-closeable seals connected to the layer of material, in accordance with at least one example embodiment.
Figure 15F:
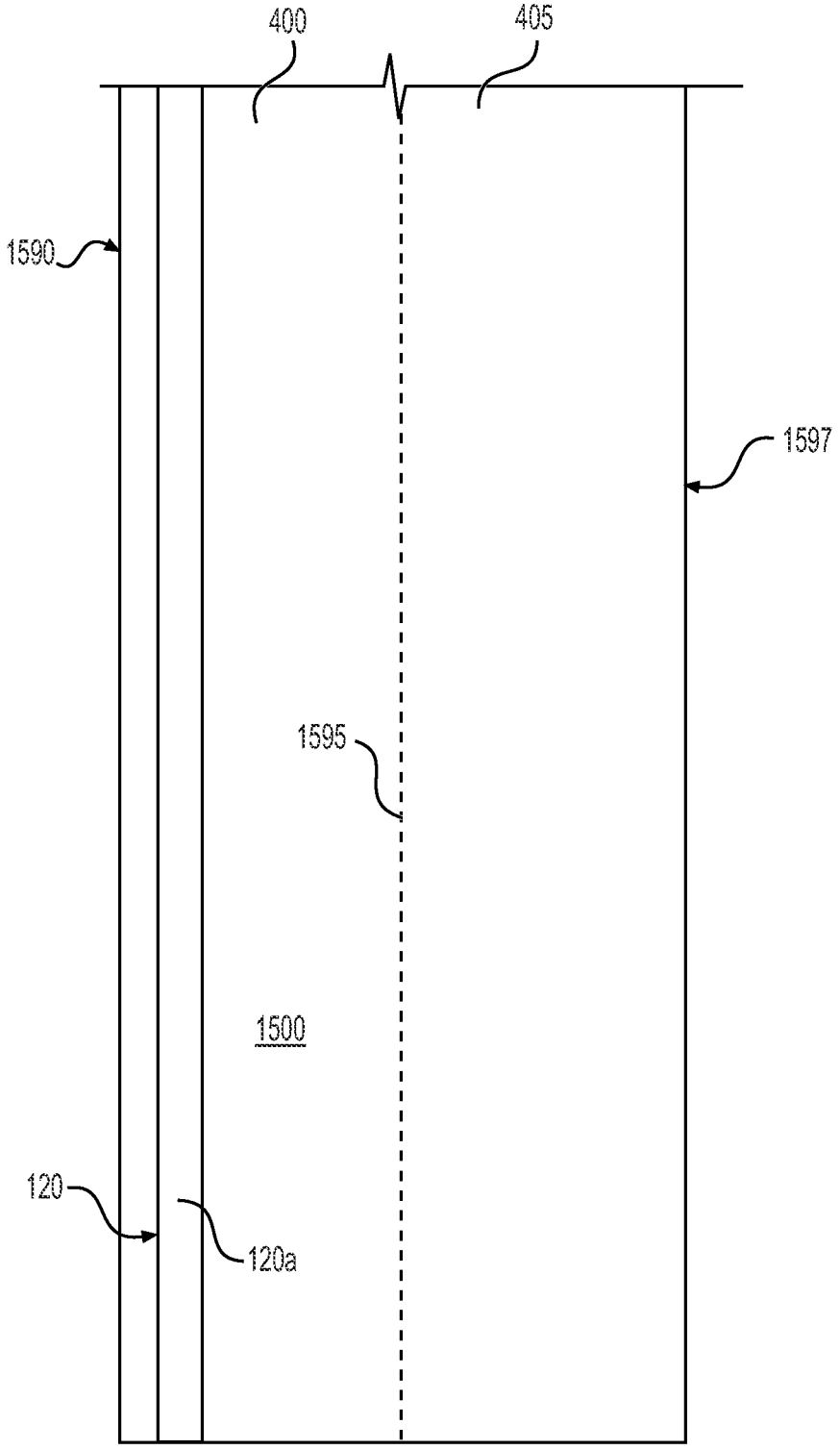
FIG. 15F is an illustration of a layer of material with a re-closeable seal connected to the layer of material, in accordance with at least one example embodiment.
Figure 15G:
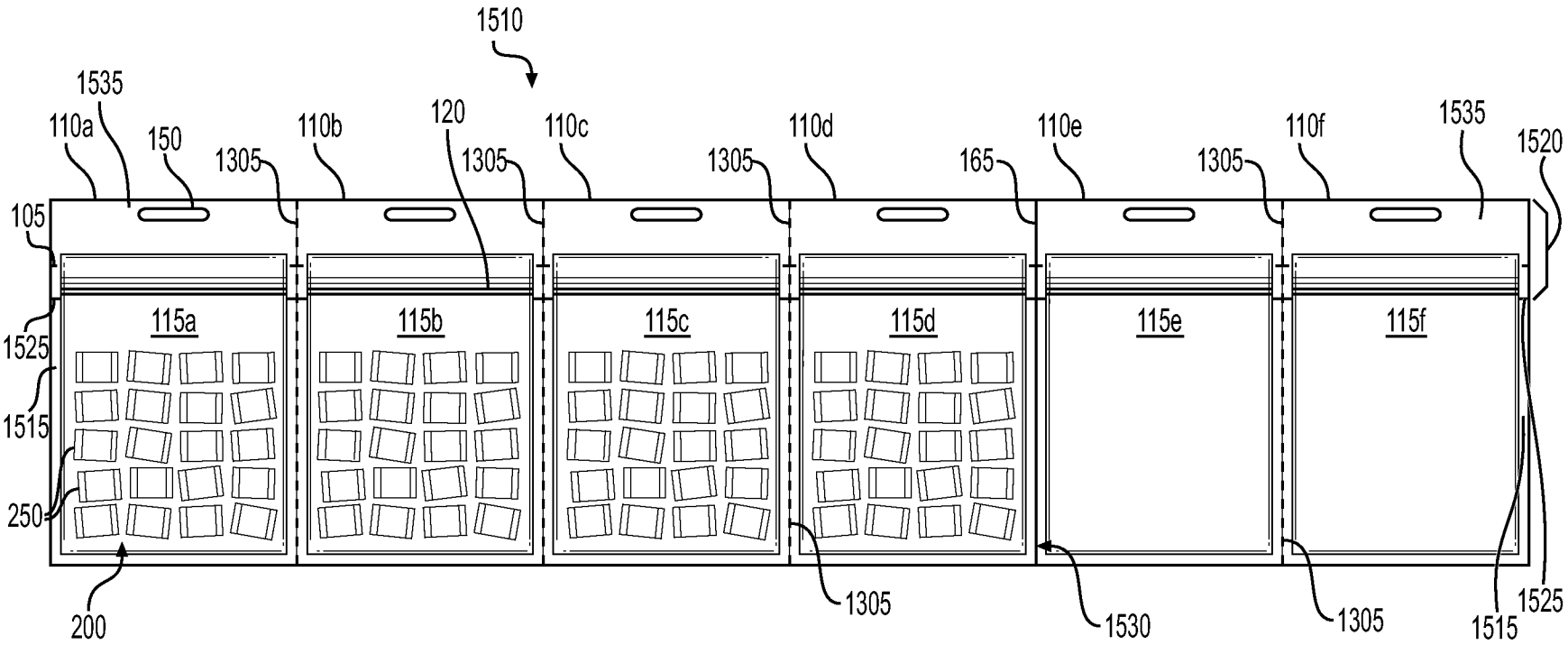
FIG. 15G is an illustration of an inner package made from the layer of material, in accordance with at least one example embodiment.

FIG. 15D is an illustration of the layer of material 1500 with portions of re-closeable seals 120 connected to the layer of material 1500, in accordance with at least one example embodiment. FIG. 15E is an illustration of the layer of material 1500 with portions of re-closeable seals 120 connected to the layer of material 1500, in accordance with at least one example embodiment. FIG. 15F is an illustration of the layer of material 1500 with the re-closeable seal 120 connected to the layer of material 1500, in accordance with at least one example embodiment.

In at least one example embodiment, the first strip 1580 and the second strip 1585 can be cut into sections and bonded onto the layer of material 1500 to form a pre-processed layer of material 1590 (FIG. 15D) that can later be formed into an inner package 1510 (FIG. 15G). In at least another example embodiment, the first strip 1580 and the second strip 1585 can remain uncut, or cut into lengthy sections (sections that can be formed into a complete inner package, or several inner packages), where the first strip 1580 and the second strip 1585 are bonded onto the layer of material 1500 to form a pre-processed layer of material 1597 (FIG. 15E) that can later be formed into the inner package 1200 (FIG. 12). In at least one example embodiment, the re-closeable seal 120 initially remains one singular element (e.g., the first strip 1580 and the second strip 1585 are not separated), and a lower side of the re-closeable seal 120 is first bonded to one side of the layer of material 1500 (as shown in FIG. 15F), and later during a further processing of the layer of material 1550 an upper side 120*a* of the re-closeable seal 120 is then bonded to another side of the layer of material 1500 (e.g., the re-closeable seal 120 is bonded to the second sheet of material 405). In at least one example embodiment, the re-closeable seal 120, the first strip 1580 and/or the second strip 1585 are bonded onto the layer of material 1500 through heat sealing, the use of an adhesive, stitching, spot heat sealing (in combination or in lieu of heat sealing), an application of a solvent, etc. Other means of bonding are also contemplated.

FIG. 15G is an illustration of the inner package 1510 that has been made from the pre-processed layer of material 1590 (using any of the pre-processing shown in FIGS. 15D-F), in accordance with an example embodiment.

In at least one example embodiment, the first layer of material (or first portion) 400 and the second layer of material (or second portion) 405 are joined in order to form the inner package 1510. In at least one example embodiment, the inner package 1510 includes a first (initial) heat sealed region 1515, where the first sheet of material 400 and the second sheet of material 405 are joined, or partially joined, via the first heat sealed region 1515, where this could for instance be a heat sealing (crimping) process. In at least one example embodiment, the first heat sealed region 1515 can be used, for example, to at least partially assist in defining the compartments 115. In at least one example embodiment, the first heat sealed region 1515 can leave a top end 1520 of the inner package 1510 open and accessible for filling (see a border 1525 of the first heat sealed region 1515, in FIG. 15G). In at least one example embodiment, an added heat sealing process at a second heat sealed region 1535 can be performed to close the top end 1520 of the inner package 1510, once some or all of the compartments 115 are filled with the consumer product 200.

In at least one example embodiment, the inner package 1510 includes six of more panels 110, where each panel 110 includes at least one compartment 115. In at least one example embodiment, the inner package 1510 includes a fifth panel 110*e* with a fifth compartment 115*e* and a sixth panel 110*f* with a sixth compartment 115*f*. In at least one example embodiment, the fifth compartment 115*e* and the sixth compartment 115*f* are left empty, while the other compartments 115 are filled with the consumer product 200. In at least one example embodiment, none of the compartments 115 are left empty. In at least one example embodiment, half of the compartments 115 are left empty, or a different number of compartments 115 are left empty, while a remaining number of the compartments 115 are filled with the consumer product 200.

In at least one example embodiment, the re-closeable seals 120 and/or the tear-points 105 are stamped onto the first sheet of material 400 and/or the second sheet of material 405, rather than pre-fabricated and then bonded onto the layer of material 1500 (as in FIG. 15D). In at least one example embodiment, the stamping can occur prior to joining the first sheet of material 400 and the second sheet of material 405, during joining, or after joining. In another example embodiment, the re-closeable seals 120 and/or tear-points 105 are pre-fabricated on the sheet of material 1500 by other means, prior to the sheet of material 1500 being processed or cut to form the inner package 1510.

In another example embodiment, in lieu of folding the layer of material 1500 (FIGS. 15A and/or 15D-F) to form the inner package 1510, the inner package 1510 can be formed from a material that is fabricated through a combined process of extruding, molding and/or blowing to form the inner package 1510 and the compartments 115. Other fabrication methods are contemplated.

In at least one example embodiment, the divider 165 at an interface 1530 between a panel with a full compartment and a panel with a compartment left empty (e.g., the divider between the fourth panel 110*d* and the fifth panel 110*e*) is a non-perforated divider 165, whereas the remaining dividers 1305 are perforated lines or weakened lines that act acts as tear-lines. In at least one example embodiment, all of the dividers define tear-lines, or some of the dividers define tear-lines.

Figure 15H:
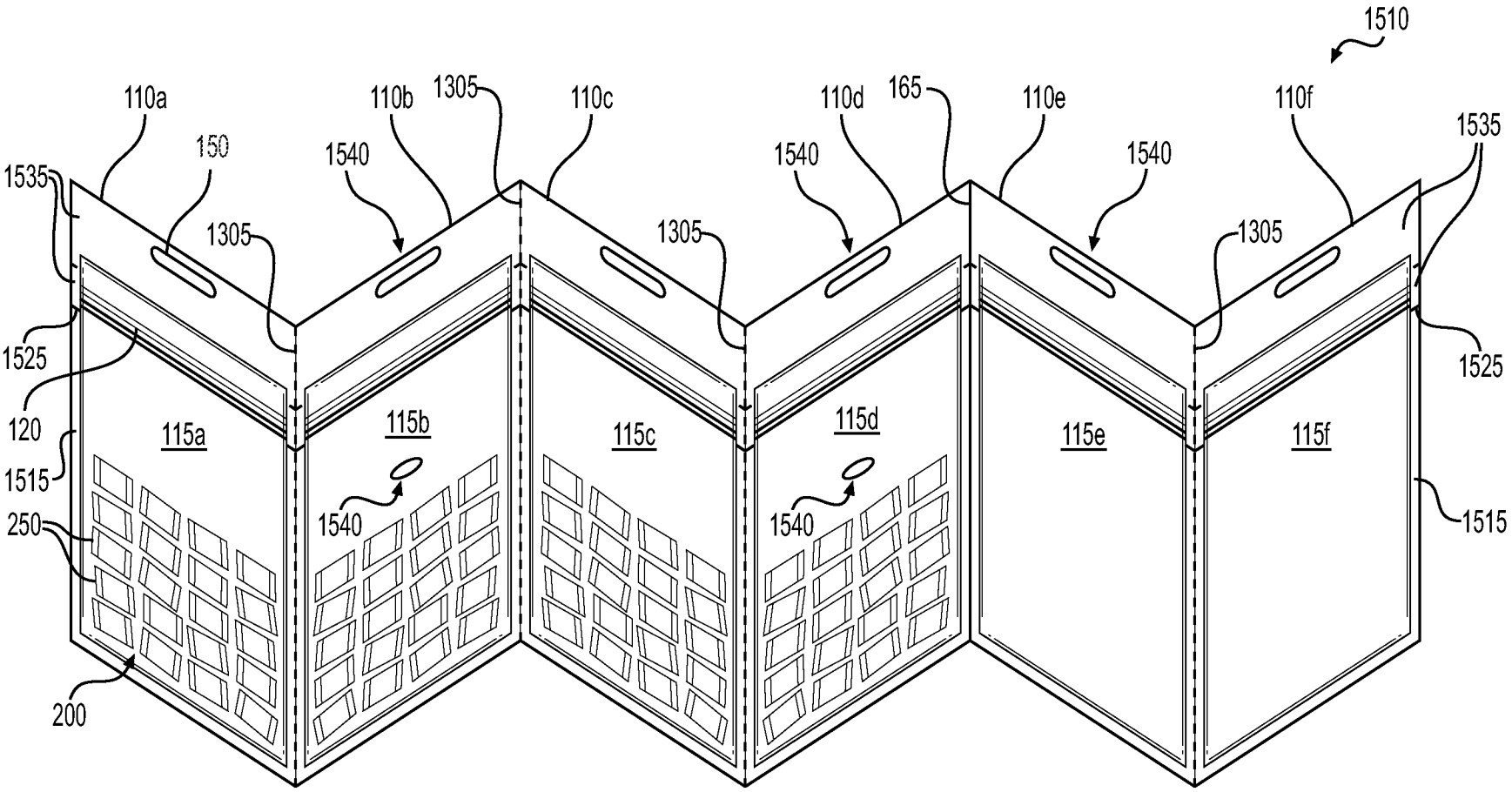
FIG. 15H is an illustration of an inner package that has been filled with a consumer product, in accordance with at least one example embodiment.
Figure 15I:
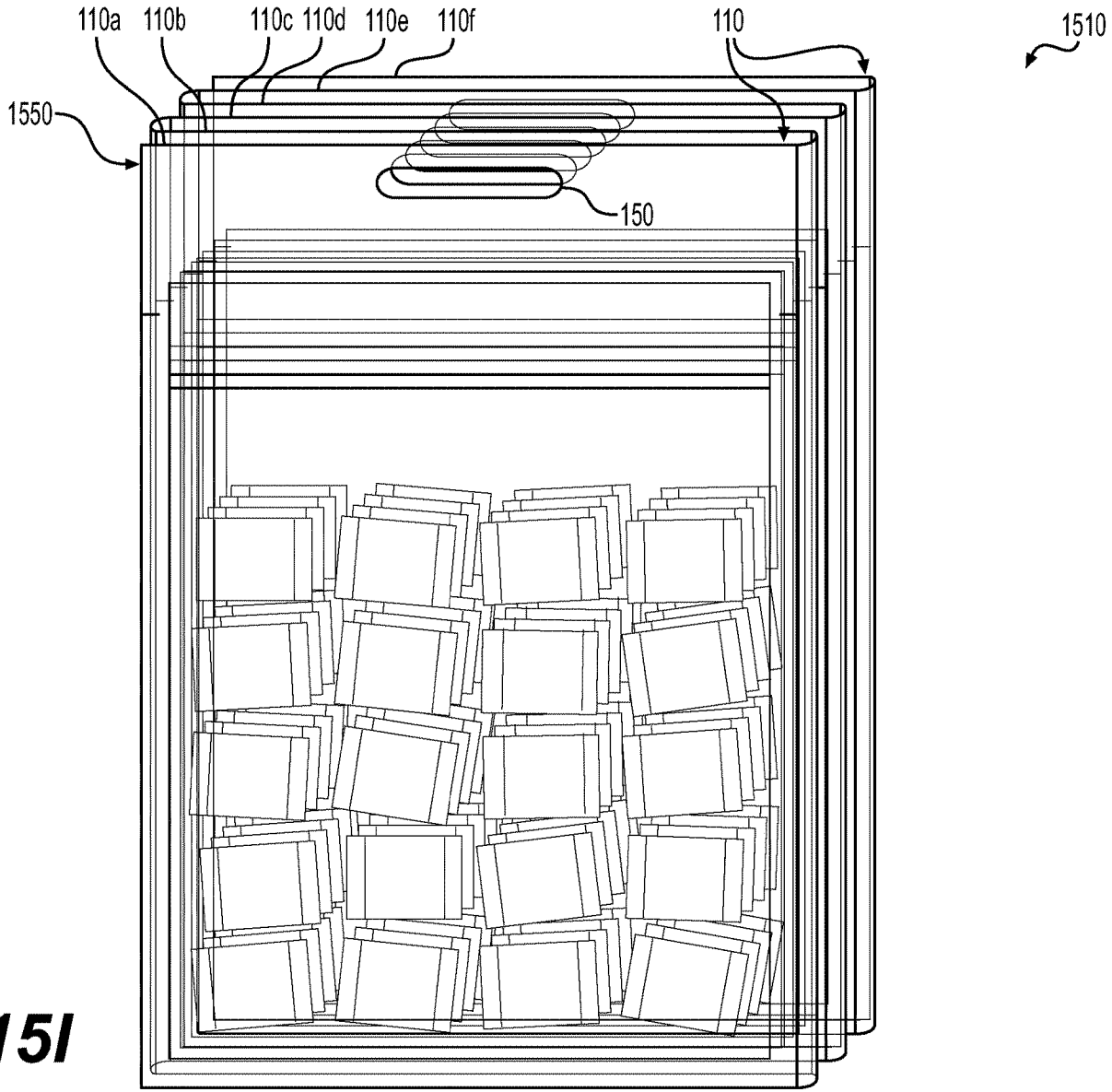
FIG. 15I is an illustration of an inner package in a folded configuration, in accordance with at least one example embodiment.
Figure 15J:
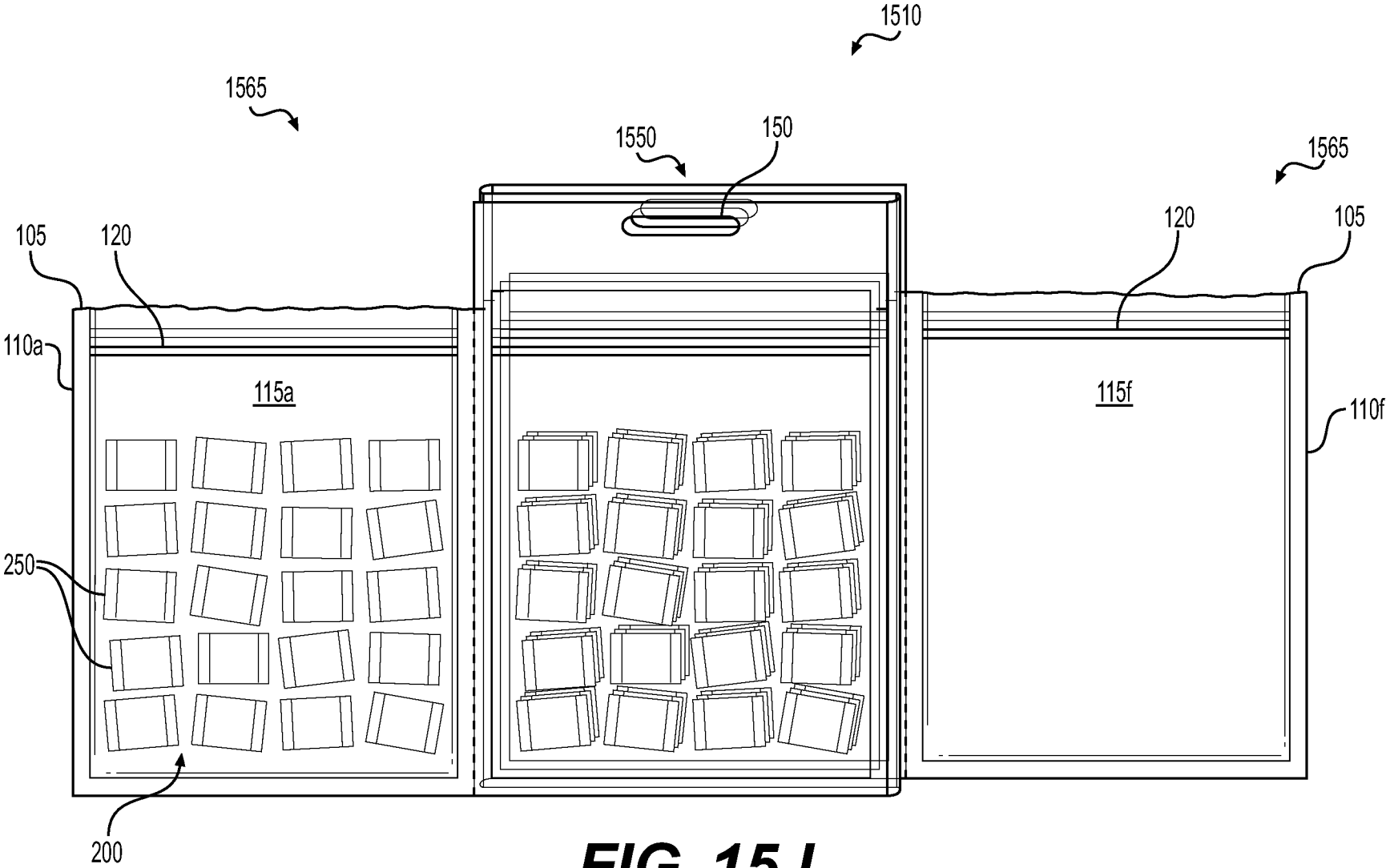
FIG. 15J is an illustration of an inner package in use, where end panels have been separated and extended from a folded configuration, in accordance with at least one example embodiment.
Figure 15K:
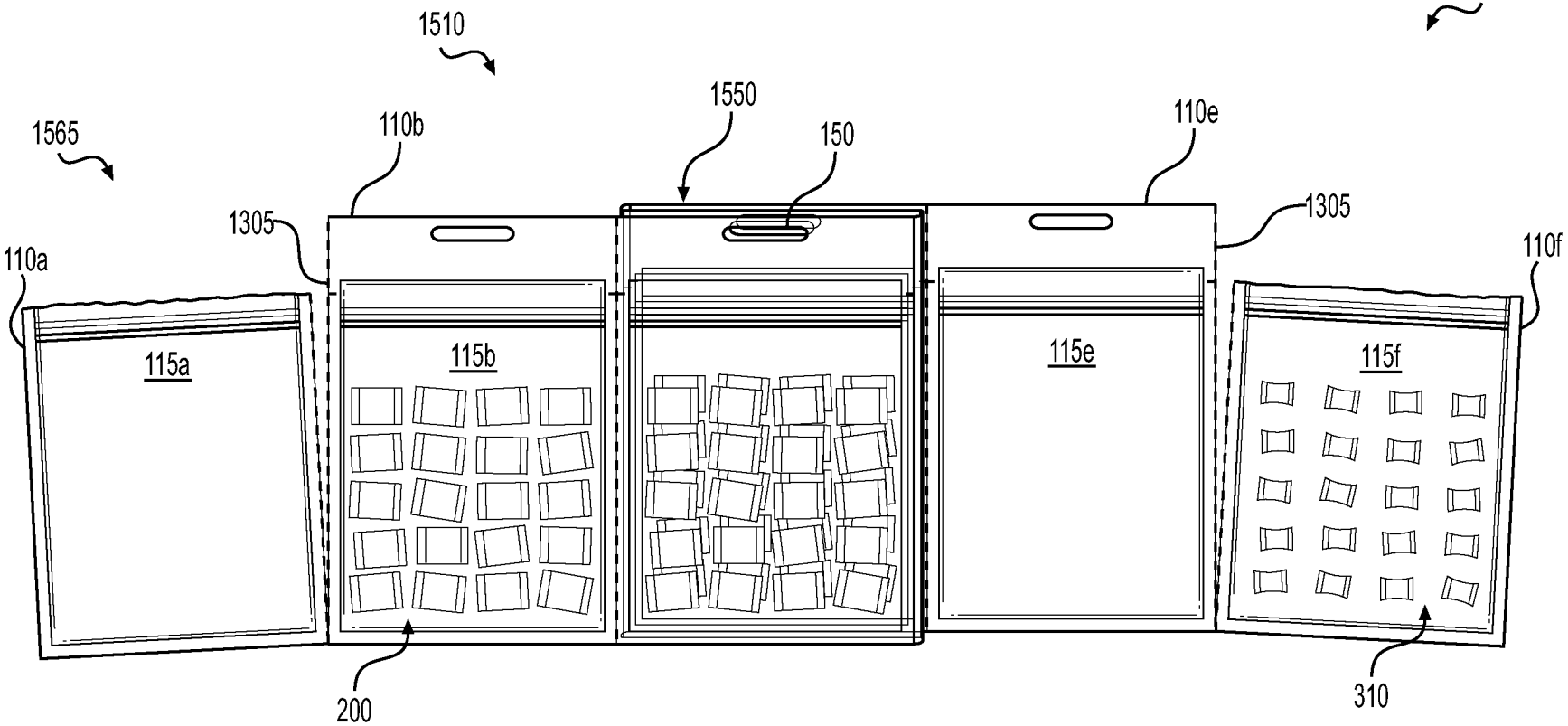
FIG. 15K is an illustration of end panels being removed from a folded configuration, where additional panels have been separated from the folded configuration, in accordance with at least one example embodiment.

In at least one example embodiment, the dividers 1305 are tear-lines that allow some of all of the panels 110 to be removed from the inner package 1510 as the consumer product 200 within the inner package 1510 is consumed (as discussed in more detail in FIGS. 15J and 15K). In at least one example embodiment, the fourth panel 110*d* and the fifth panel 110*e* may not be intended or designed to be separated from each other, as the fourth panel 110*d* and the fifth panel 110*e* are intended to be discarded together (as discussed in more detail in FIGS. 15J and 15K).

In at least one example embodiment, either the divider 1305 or the divider 165 is used at an interface between each one of the panels 110. In at least one example embodiment, other combinations of the divider 1305 and the divider 165 are contemplated.

In at least one example embodiment, the slit 150 is included on a side edge of some of all of the panels 110, rather than a top end as shown in FIG. 15G. In at least one example embodiment, the slit 150 is included on a lower end of some or all of the panels 110. In at least one example embodiment, the slit 150 of some or all of the panels 110 will align, once the inner package 900 is in a folded configuration (see at least FIG. 15I).

In at least one example embodiment, each of the slits 150, the notches 105 and/or perforations for the divider 1305 (to form the divider 1305 into a tear-line) can be formed following or during heat sealing, or formed at any point prior to heat sealing including during the pre-processing of the layer of material (FIGS. 15D-F), before the pre-processing or immediately following the pre-processing.

FIG. 15H is an illustration of the inner package 1510 that has been at least partially filled with the consumer product 200, in accordance with an example embodiment.

In at least one example embodiment, a second (additional) heat sealed region 1535 is applied to the inner package 1510 to seal the inner package 1510. In at least one example embodiment, the second heat sealed region 1535 can be applied to seal a top portion of some or all of the compartments 115. In at least one example embodiment, the second heat sealed region 1535 can abut the first heat sealed region 1515. In at least one example embodiment, the second heat sealed region 1535 is applied to the inner package 1510 once at least some of the compartments 115 are filled with the consumer product 200. In at least one example embodiment, the inner package 1510 includes only a single heat sealing process, where the heat sealing occurs in the first heat sealed region 1515 and the second heat sealed region 1535. In at least one example embodiment, more than two heat sealing processes are performed on the inner package 1510. In at least one example embodiment, the inner package 1510 is heat sealed as the inner package 1510 is at least partially filled with the consumer product 200, or after the inner package 1510 is at least partially filled with the consumer product 200.

In at least one example embodiment, an adhesive 1540 is applied to at least a portion of a front and/or back surface of the panels 110, at locations that will interface with other panels 110 when the inner package 1510 is folded. In at least one example embodiment, the adhesive 1540 is applied at spot locations. In at least one example embodiment, the adhesive 1540 is applied at ends of the panels 110, or at various locations on a front and/or back of some or all of the panels 110, as shown in FIG. 15G. In at least one example embodiment, the adhesive 1540 is a hot melt glue, a gummy adhesive, a fugitive glue, a repositionable glue, a silicon adhesive, or another type of adhesive that is capable of holding the panels 110 while allowing the panels 110 to later be separated with relatively low effort. In at least one example embodiment, the adhesive 1540 is a low temperature adhesive that remains in a semi-solid form at room temperature, and remains in a semi-solid form at normal outdoor ambient temperatures that may include a relatively wide range of temperatures (from hot climates to cold climates).

In at least one example embodiment, and as shown in FIG. 15H, the inner package 1510 is folded into a folded configuration 1550 (see FIG. 15I), or an "accordion-style" configuration. In at least one example embodiment, and as shown in FIG. 15I, the inner package 1510 is folded so that each panel 110 is folded onto the adjacent panel 110, to form the folded configuration 1550.

In at least one example embodiment, the adhesive 1540 maintains the inner package 1510 in the folded configuration 1550, by holding the panels 110 of the inner package 1510 to each other. In at least one example embodiment, an adhesive is not applied to the inner package 1510 that is in the folded configuration 1550. In at least one example embodiment, heat sealing is used in lieu of, or in combination with, the adhesive 1540, in order to hold some or all of the panels 110 together in the folded configuration 1550. In another example embodiment, the panels 110 of the inner package 1510 are held together by other means, such as an application of tape, glue that hardens (becomes solid after drying), or other structure suitable for holding the panels 110 of the inner package 1510 together. In another example embodiment, each panel 110 of the inner package 1510 lies on top of each other, following folding, without an application of an adhesive or other structure.

FIG. 15I is an illustration of the inner package 1510 in the folded configuration 1550, in accordance with an example embodiment.

In at least one example embodiment, each of the panels 110 is folded on top of each other, in this configuration. In at least one example embodiment, the slit 150 of each of the panels 110 aligns, once the inner package 1510 is in the folded configuration 901.

In at least one example embodiment, the aligned slits 150 of the inner package 1510 in the folded configuration 1550 can allow the inner package 1510 to be hung on personal items such as a key chain, backpack, fanny pack, bicycle, cellphone case, etc.

FIG. 15J is an illustration of the inner package 1510 in use, where end panels 1565 (e.g., the first panel 110*a* and the sixth panel 110*f*) have been separated and extended from the remaining panels 110 of the inner package 1510 that remain in the folded configuration 1550, in accordance with an example embodiment.

In at least one example embodiment, and as shown in FIG. 15J, the first panel 110*a* includes the consumer product 200 in the first compartment 115*a*, where a top end of the first panel 110*a* has been removed via the tear-point 105 to access the consumer product 200. In at least one example embodiment, a top end of the sixth panel 110*f* has also been removed to allow the consumer product 200 to be stored in the sixth compartment 115*f* after the consumer product 200 has been consumed. In at least one example embodiment, the re-closeable seals 120 can retain the contents of the sixth compartment 115*f* while maintaining a freshness of the consumer product 200 in the first compartment 115*a*.

In at least one example embodiment, the end panels 1565 do not need to be separated and extended from the remainder of the inner package 1510 for the end panels 1565 to be used. That is to say, in at least one example embodiment, a top end of one or both of the end panels 1565 can be removed and the compartments 115 can be accessed and used, while all panels 110 of the inner package 1510 remain in the folded configuration 1550 (see FIG. 15I). Following use of the end panels 1565 (e.g., when the consumer product 200 in the first compartment 115*a* of the first panel 110*a* is fully consumed and/or when the sixth compartment 115*f* of the sixth panel 110*f* is full), either or both of the end panels 1565 can then be separated and removed from a remainder of the inner package 1510. In at least one example embodiment, once the end panels 1565 are removed from a remainder of the inner package 1510, new end panels (e.g., the second panel 110*b* and the fifth panel 110*e*) can be opened at the top, and accessed and used, while remaining in the folded configuration 1550.

In at least one example embodiment, the aligned slits 150 of the inner package 1510 in the folded configuration 1550 can allow the inner package 1510 to be hung on personal items, while allowing one or both of the end panels 1565 to be separated and extended to facilitate a convenient use of the inner package 1510.

FIG. 15K is an illustration of the end panels 1565 (e.g., the first panel 110*a* and the sixth panel 110*f*) being removed from the folded configuration 1550, where additional panels (e.g., the second panel 110*b* and the fifth panel 110*e*) are being separated and extended from the remainder of the inner package 1510, in accordance with an example embodiment.

In at least one example embodiment, and as shown in FIG. 15K, the first compartment 115*a* is empty as the consumer product 200 has been depleted, and the spent (consumed) consumer product 310 is contained in the sixth compartment 115*f*. In at least one example embodiment, the end panels 1565 are removed from a remainder of the inner package 1510 by using the dividers 1305 that define tear lines. In at least one example embodiment, once the second panel 110*b* and the fifth panel 110*e* have been separated from the folded configuration 1550, a top end of the second panel 110*b* and the fifth panel 110*e* can be removed to access the second compartment 115*b* and the fifth compartment 115*e*.

In at least one example embodiment, once the first panel 110*a* and the sixth panel 110*f* are removed from a remainder of the inner package 1510, the second panel 110*b* and the fifth panel 110*e* become a new set of end panels. Once the consumer product 200 in the second compartment 115*b* of the second panel 110*b* is used, the second panel 110*b* can be removed from a remainder of the inner package 1510. In another example embodiment, after the consumer product 200 in the first compartment 115*a* is consumed, the first panel 110*a* can remain connected to the inner package 1510 so that the first compartment 115*a* can be re-purposed and used to retain the spent consumer product 310.

In at least one example embodiment, because the second compartment 115*b* remained sealed, prior to depletion of the first compartment 115*a*, the consumer product 200 in the second compartment 115*b* remains fresh, prior to consummation.

In at least one example embodiment, the inner package 1510 can be used by continuing to separate and remove end panels, prior to an ultimate disposal of the inner package 1510. In at least one example embodiment, a final empty compartment (e.g. the fifth compartment 115*e*, as shown in FIG. 15H) may be configured to remain connected to a final filled compartment (e.g., the fourth compartment 115*d*, as shown in FIG. 15G), so that the final two panels (e.g., the fourth panel 110*d* and the fifth panel 110*e*) can more easily be disposed of effectively, together.

Figure 16:
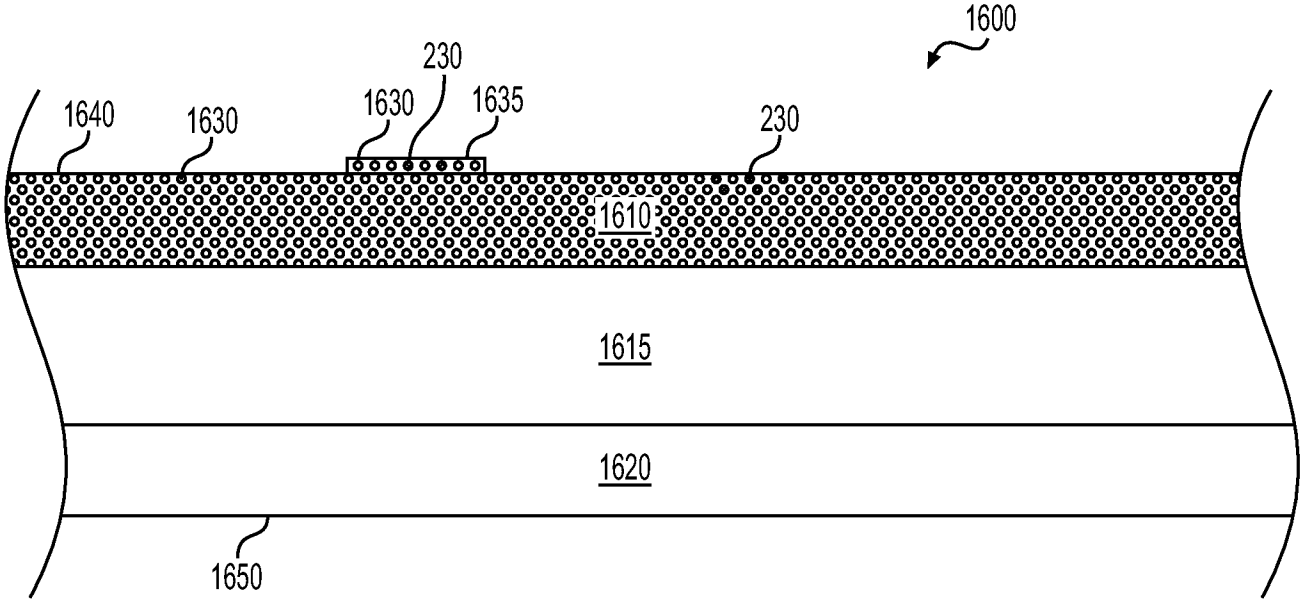
FIG. 16 is an illustration of a cross-section of a layer of material for an inner package, in accordance with at least one example embodiment.

FIG. 16 is an illustration of a cross-section of a layer of material 1600 that can be used to form any of an inner package, in accordance with an example embodiment.

In at least one example embodiment, the layer of material 1600 is used to make any of the inner packages (e.g., the inner package 100, 1100, 1200, 1300, 1400 and 1510) of the example embodiments. In at least one example embodiment, the layer of material 1600 can be used in a same manner as the layer of material 1500 described in relation to FIG. 15A.

In the example embodiment, the layer of material 1600 is gas and moisture impermeable. In at least one example embodiment, the layer of material 1600 is a multi-layer structure that includes a gas/moisture impermeable layer 1615 bracketed by a first polymer layer 1610 and a second polymer layer 1620 that are made from low melting point polymers. In at least one example embodiment, the gas/moisture impermeable layer 1615 is a foil layer that includes a foil, a foil laminate, a composite material with at least one foil layer, an aluminum layer, an aluminum alloy layer, a pliable metalized film layer, or a combination of one or more of these. In an alternative embodiment, the gas/moisture impermeable layer 1615 is a polymer that includes an elastomer, plastic, vinyl, rubber, butyl rubber, polyethylene, ethylene vinyl alcohol (EVOH), or a composite of any of these materials, or a composite of pliable or semi-pliable polymer materials that are gas and moisture impermeable. In at least one example embodiment, the gas/moisture impermeable layer 1615 includes at least one cyclic olefin copolymer (COC). In at least one example embodiment, the layer of material 1600 only includes one of more layers of COC.

A "gas impermeable" material is a material with an oxygen transmission rate (OTR) of less than 0.016 $cm^2/m^2/day$ at test conditions of 73° F. with 0% relative humidity using American Society for Testing and Materials (ASTM) standard D-3985. A "moisture impermeable" material is a material with a moisture vapor transmission rate (MVTR) of less than 0.016 grams of water/$m^2$/day at test conditions of 100° F. with 90% relative humidity using ASTM standard F-1249. A "gas/moisture impermeable layer" is a layer of material that has both the "gas impermeable" and "moisture impermeable" properties.

In at least one example embodiment, the polymer layers 1610/1620 are made from a relatively low melting point polymer, relative to the gas/moisture impermeable layer 1615, where the polymer layers 1610/1620 may be a same polymer material, or a different polymer material. In at least one example embodiment, the polymer layers 1610/1620 include biaxially-oriented polyethylene terephthalate (BO-PET), polyethylene (PE), polypropylene, other similar low-melting point polymers or thermoplastics, or combinations thereof. The polymer layers 1610/1620 may, for instance, include a layer or layers of elastomers, plastics, or other pliable polymer layers that have a relatively low melting point, or combinations of these materials. In at least one example embodiment, the polymer layers 1610/1620 are made from a material that allows oxygen migration/diffusion through the polymer layers 1610/1620, with an efficient water/vapor transmission rate, where the materials listed above offer such properties.

In at least one example embodiment, the polymer layers 1610/1620 are made from a recyclable material. In at least one example embodiment, the polymer layers 1610/1620 are made from at least one of polyethylene terephthalate (PET), high-density polyethylene (HDPE), or polyvinyl chloride (PVC), each of which are recyclable. In at least one example embodiment, the inner package is made only from one or more layers of recyclable material.

In at least one example embodiment, an oxygen scavenger 1630 is connected to or infused within at least one of the polymer layers 1610/1620. In at least one example embodiment, the oxygen scavenger 1630 is connected to a first outer surface 1640 of the first polymer layer 1610, infused within the first polymer layer 1610, or both. In at least one example embodiment, the first polymer layer 1610 is used to make an interior (inner) surface of the compartments of the inner packages. In another example embodiment, the oxygen scavenger 1630 is connected to the first outer surface 1640 of the first polymer layer 1610 and/or connected to a second outer surface 1650 of the second polymer layer 1620, or infused within either or both of the first polymer layer 1610 and the second polymer layer 1620.

In another embodiment, active elements of the oxygen scavenger 1630 are infused into at least one of the polymer layers 1610/1620. In at least one example embodiment, the active elements of the oxygen scavenger 1630 include iron fragments. In at least one example embodiment, the iron fragments are able to bind with a sequester free-oxygen via an iron oxidation reaction. In at least one example embodiment, a light-sensitive activator is co-mingled or infused with the active elements of the oxygen scavenger 1630. In at least one example embodiment, the active elements of the oxygen scavenger 1630 and the light-sensitive activator are homogenously mixed together within one or both of the polymer layers 1610/1620.

In at least one example embodiment, the oxygen scavenger 1630 may come in various forms, and may or may not be in direct contact with the consumer product 200 in the compartments of the inner packages. In at least one example embodiment, the oxygen scavenger 1630 is exposed to an interior of the compartments, once the inner packages are formed and sealed. In at least one example embodiment, the oxygen scavenger 1630 is able to form an oxygen concentration gradient with an interior of the compartments, once the inner packages are formed and sealed, even if the oxygen scavenger 1630 is not in direct contact with an interior of the compartments.

In some examples, a quantity of the oxygen scavenger 1630 is connected to or infused within an interior (inner) layer of each of the compartments, such that the oxygen scavenger 1630 is able to remove an expected volumetric quantity of oxygen within the compartments, once the inner packages are formed. In at least one example embodiment, the oxygen scavenger 1630 is not directly contacting the first outer surface 1640, but is instead infused within the first polymer layer 1610, or is in another polymer layer between the first polymer layer 1610 and the gas/moisture impermeable layer 1615, where the oxygen scavenger 1630 is able to create an oxygen gradient that draws free-oxygen across the first outer surface 1640 and into or through the first polymer layer 1610 to bind with and sequester the free-oxygen.

In at least one example embodiment, the light-sensitive activator includes molecules that, when exposed to a light source, will create a free-radical that binds with free-oxygen in a reduction reaction, so that the free-oxygen will in turn bind with the elements of the oxygen scavenger 1630 to initiate (activate) a further reaction between the oxygen scavenger 1630 and additional free-oxygen.

In some embodiments that involve the oxygen scavenger 1630 and the light-sensitive activator being connected to or infused within the layer of material 1600, one or both surfaces of the layer of material 1600 can be shielded from a light source prior to a complete formation of the inner package. This may be accomplished by keeping the oxygen scavenger 1630 and/or the first polymer layer 1610 covered, stored in a roll, or stored in a light-depleted environment, in order to ensure that the light-sensitive activator is not exposed to a light source that would otherwise inadvertently initiate the reaction between the light-sensitive activator and free-oxygen prior to the formation of the inner package.

In at least one example embodiment, the first outer surface 1640 of the layer of material 1600 forms an interior surface of the compartments of the inner package, where the oxygen scavenger 1630 is able to draw free-oxygen to or through the first outer surface 1640, once the inner package is sealed and at least some of the compartments of the inner packages contain the consumer product 200. In at least one example embodiment, the oxygen scavenger 1630 is, over time, able to reduce a concentration of free-oxygen (molecular oxygen) within a head-space of the compartments, thereby effectively creating or approximating a chemically-inert atmosphere within the compartments. In some example embodiments, the chemically-inert atmosphere is created even in the absence of any process that may remove air and/or free-oxygen from the compartments, or replace air and/or free-oxygen with an inert gas, prior to the inner package being sealed. In another embodiment, a process of removing air or free-oxygen from the compartments, or replacing air or free-oxygen from the compartments, may be used in lieu of using the oxygen scavenger 1630 in or on the layer of material 1600, or used in conjunction with using the oxygen scavenger 1630 in or on the layer of material 1600.

In at least one example embodiment, the light-sensitive activator initiates a reaction with free-oxygen by being exposed to a light source that is ultraviolet (UV) light. In another embodiment, the light-sensitive activator initiates a reaction with free-oxygen by being exposed to a light source that is visible light, or portions of the spectrum of visible light. In some embodiments, the light-sensitive activator is part of the oxygen scavenger 1630, or co-mingled with the elements or materials of the oxygen scavenger 1630.

In at least one example embodiment, the layer of material 1600 includes the gas/moisture impermeable layer 1615, where the polymer layers 1610/1620 have a relatively low melting point, in order to provide a pliable or semi-pliable material that is easy to work with, is impervious to oxygen/gas exchange, and/or can be conveniently joined and/or crimped (heat sealed) using relatively low temperature heating. In at least one example embodiment, heat sealing of the layer of material 1600 of the inner package is accomplished using an applied pressure of about 20-40 psi (138-276 kPa) for a duration of less than 1 minute, with an applied temperature of about 137-205° C., where the polymer layers 1610/1620 (described herein) are able to be heat sealed under these conditions. In another example embodiment, heat sealing of the inner package is accomplished using an applied pressure of about 30 psi (207 kPa) with an applied temperature of about 137-205° C., or about 170° C., where the polymer layers 1610/1620 (described herein) are able to be heat sealed under these conditions.

In at least one example embodiment, a matrix 1635 is connected to at least a portion of the first outer surface 1640 of the first polymer layer 1610. In at least one example embodiment, the matrix 1635 includes the oxygen scavenger 1630, or the active elements of the oxygen scavenger. In at least one example embodiment, the matrix 1635 is made from a material that allows oxygen migration/diffusion, in order to allow the oxygen scavenger 1630 to draw free-oxygen into the matrix 1635 and bind with the free-oxygen. The materials for the matrix 1635, described herein, allow for such migration/diffusion. In at least one example embodiment, the matrix 1635 is a polymer matrix (polymer material) or a thermoplastic. In another embodiment, the matrix 1635 is made from polyethylene. In at least one example embodiment, the polymer material of the matrix 1635 has a melting point temperature that is similar, or the same, as the melting point temperature of the first polymer layer 1610. In at least one example embodiment, the difference in melting point temperature between the first polymer layer 1610 and the polymer material of the matrix 1635 is about 25° C. or less, or about 10° C. or less, or about 5° C. or less. In at least one example embodiment, the polymer material of the matrix 1635 is a same material as the material that forms the first polymer layer 1610. In at least one example embodiment, a melting point temperature of the polymer material of the matrix 1635 is lower than a melting point temperature of the first polymer layer 1610.

In at least one example embodiment, the matrix 1635 and/or the first polymer layer 1610 includes the desiccant 230, either in conjunction with the oxygen scavenger 1630 or in lieu of the oxygen scavenger 1630.

In another example embodiment, the layer of material 1600 is a single layer material, where the single layer is the gas/moisture impermeable layer 1615. In another embodiment, the layer of material 1600 is a multi-layer material, where each of the layers is the gas/moisture impermeable layer 1615. In at least one example embodiment, the layer of material 1600 is devoid of polymer layers, or devoid of low melting point outer layers. In at least one example embodiment, the layer of material 1600 that includes the gas/moisture impermeable layer 1615 works in conjunction with a reduced head-space of each of the compartments 115 (as discussed herein), in order to reduce oxygen and/or moisture exposure for the consumer product 200 in each of the compartments 115. This in turn can reduce flavor scalping caused at least in part by oxygen and moisture degradation.

Figure 17:
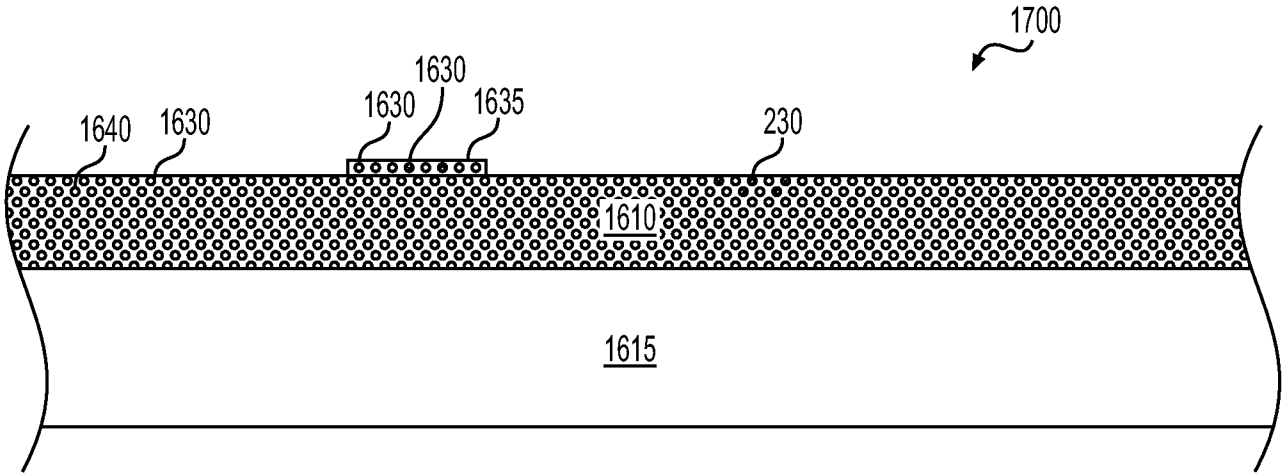
FIG. 17 is an illustration of a cross-section of another layer of material for an inner package, in accordance with at least one example embodiment.

FIG. 17 is an illustration of a cross-section of another layer of material 1700 for an inner package, in accordance with an example embodiment.

In at least one example embodiment, the layer of material 1700 is used to make any of the inner packages (e.g., the inner package 100, 1100, 1200, 1300, 1400 and 1510) of the example embodiments. In at least one example embodiment, the layer of material 1700 can be used in a same manner as the layer of material 1500 described in relation to FIG. 15A.

In at least one example embodiment, the layer of material 1700 is a multi-layer material that includes the first polymer layer 1610 and the gas/moisture impermeable layer 1615. In an embodiment, the layer of material 1700 can be joined via heat sealing, or other means, to form any of the inner packages, where the joining involves joining the first polymer layer 1610 together. For instance, the layer of material 1700 is assembled so that the first polymer layer 1610 forms an interior of the compartments of the inner packages, and the gas/moisture impermeable layer 1615 forms an exterior surface of the compartments of the inner packages. In at least one example embodiment, the oxygen scavenger 1630 is connected to the first outer surface 1640 of the first polymer layer 1610, the oxygen scavenger 1630 is infused through the first polymer layer 1610, or both. In at least one example embodiment, the light-sensitive activator is co-mingled or infused along with the active elements of the oxygen scavenger 1630 (as described in relation to the example embodiment of FIG. 16).

In another example embodiment, the layer of material 1700 includes the first polymer layer 1610 that is devoid of other layers. In this example embodiment, the oxygen scavenger 1630 may be included on either or both surfaces of the first polymer layer 1610 and/or the oxygen scavenger 1630 may be infused within the first polymer layer 1610.

Figure 18:
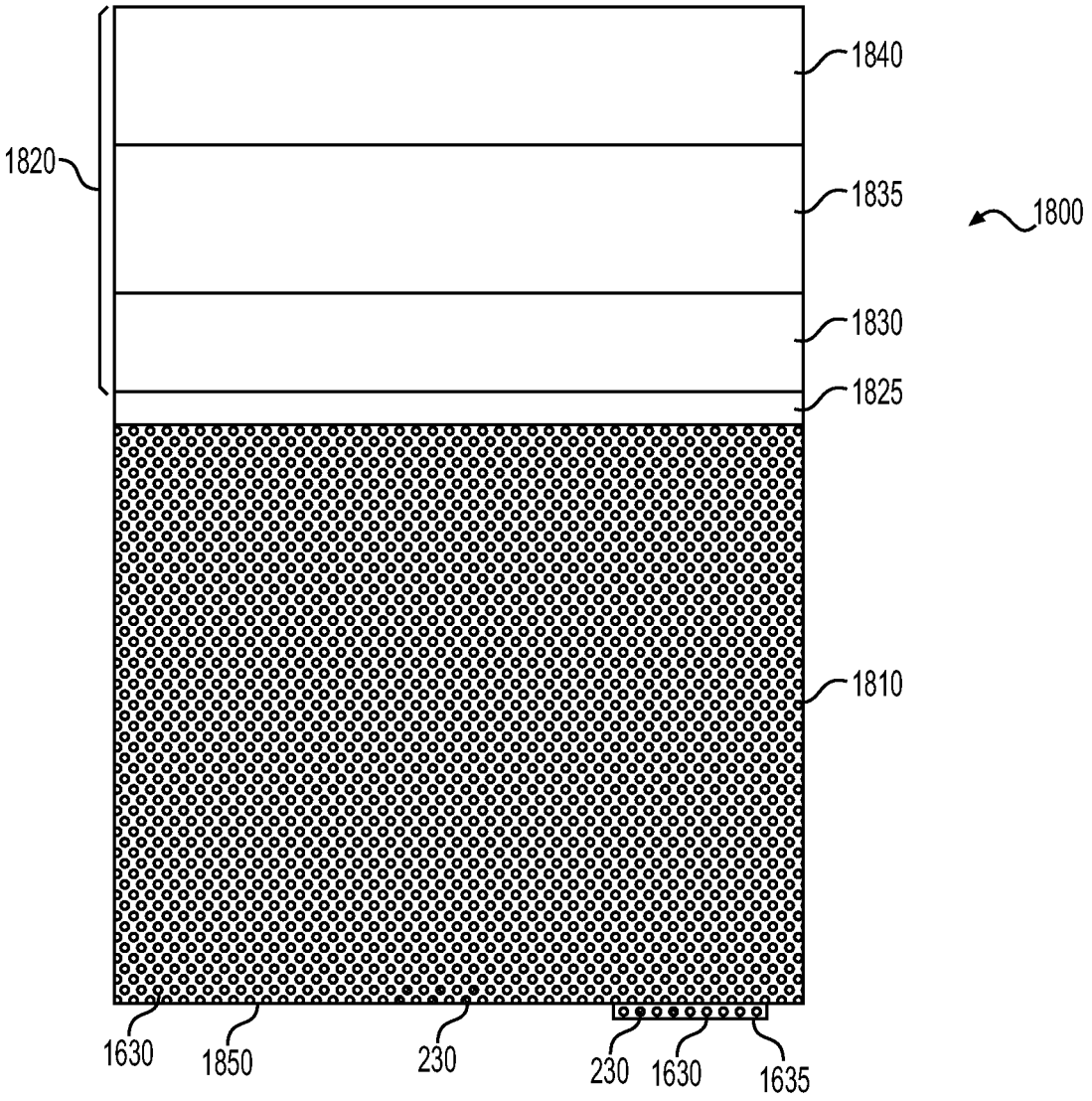
FIG. 18 is an illustration of a cross-section of another layer of material for an inner package, in accordance with at least one example embodiment.

FIG. 18 is an illustration of a cross-section of another layer of material 1800 for an inner package, in accordance with an example embodiment.

In at least one example embodiment, the layer of material 1800 is used to make any of the inner packages (e.g., the inner package 100, 1100, 1200, 1300, 1400 and 1510) of the example embodiments. In at least one example embodiment, the layer of material 1800 can be used in a same manner as the layer of material 1500 described in relation to FIG. 15A.

In at least one example embodiment, the layer of material 1800 includes several layers that form a gas/moisture impermeable layer 1820, where the gas/moisture impermeable layer 1820 includes: a biaxially-oriented polyethylene terephthalate (BOPET) layer 1840, a polyethylene (that may be a clear or translucent polyethylene, or PE) layer 1835 and a foil layer 1830. In at least one example embodiment, the layer of material 1800 also includes an adhesive layer 1825 and a sealant layer 1810. In at least one example embodiment, the sealant layer 1810 is a polyethylene-based sealant, a polyethylene terephthalate (PET)-based sealant, a resin-based sealant, or combinations of these. In at least one example embodiment, the resin-based sealant is an ionomer resin sealant, such as a Surlyn® sealant, where Surlyn® is a registered trademark of DowDuPont Inc. In at least one example embodiment, the sealant layer 1810 is a TOPAS® cyclic olefin copolymer (COC) resin sealant, such as a CXBR sealant, where TOPAS® and CXBR are registered trademarks of Bemis Company, Inc. In at least one example embodiment, the sealant layer 1810 is connected to the foil layer 1830 by the adhesive layer 1825. In at least one example embodiment, the sealant layer 1810 has a lower melting point relative to the gas/moisture impermeable layer 1820. In at least one example embodiment, the gas/moisture impermeable layer 1820 includes at least one COC layer. In at least one example embodiment, at least one COC layer is used in lieu of the BPOET layer 1840 and/or the PE layer 1835.

In another example embodiment, layer of material 1600 (FIG. 16) is the gas/moisture impermeable layer 1820, where the second polymer layer 1620 is connected to the adhesive layer 1825. In another example embodiment, the layer of material 1700 (FIG. 17) is the gas/moisture impermeable layer 1820, where the gas/moisture impermeable layer 1615 is connected to the adhesive layer 1825. In at least one example embodiment, the gas/moisture impermeable layer 1820 is only the foil layer 1830.

In at least one example embodiment, the sealant layer 1810 is made from a material that allows oxygen migration/diffusion through the sealant layer 1810, where the materials for the sealant layer 1810 listed above allow for such oxygen migration/diffusion.

In at least one example embodiment, the adhesive layer 1825 is a silicone-based adhesive, a food-grade polymer, a food-grade epoxy, combinations of these materials, or other suitable adhesives used for the storage of food-grade and/or consumable items.

In at least one example embodiment, the layer of materials 1800 includes the following layers listed with respective thicknesses: 12 microns of the BOPET layer 1840, 13 microns of the PE layer 1835, 8.9 microns of the foil layer 1830, 2.0 microns of the adhesive layer 1825 and 50.8 microns of the sealant layer 1810. In at least one example embodiment, the sealant layer 1810 is at least four times a thickness of each of the other layers of the layer of materials 1800 (e.g., the BOPET layer 1840, the PE layer 1835, the foil layer 1830, and the adhesive layer 1825). In at least one example embodiment, the sealant layer 1810 is thicker than each of the other layers of the layer of materials 1800 combined (e.g., thicker than the combination of the BOPET layer 1840, the PE layer 1835, the foil layer 1830, and the adhesive layer 1825).

In at least one example embodiment, in order to join the layer of material 1800 to form the inner package of some of the example embodiments, or the compartments of the inner packages the sealant layer 1810 is joined, causing the sealant layer 1810 to form an interior surface of compartments.

In at least one example embodiment, the oxygen scavenger 1630 is connected to an outer surface 1850 of the sealant layer 1810, the oxygen scavenger is infused within the sealant layer 1810, or both. In at least one example embodiment, the exterior surface of the inner package is the BOPET layer 1840. In at least one example embodiment, the light-sensitive activator is co-mingled or infused along with the active elements of the oxygen scavenger 1630 (as described in relation to the example embodiment of FIG. 16).

Figure 19:
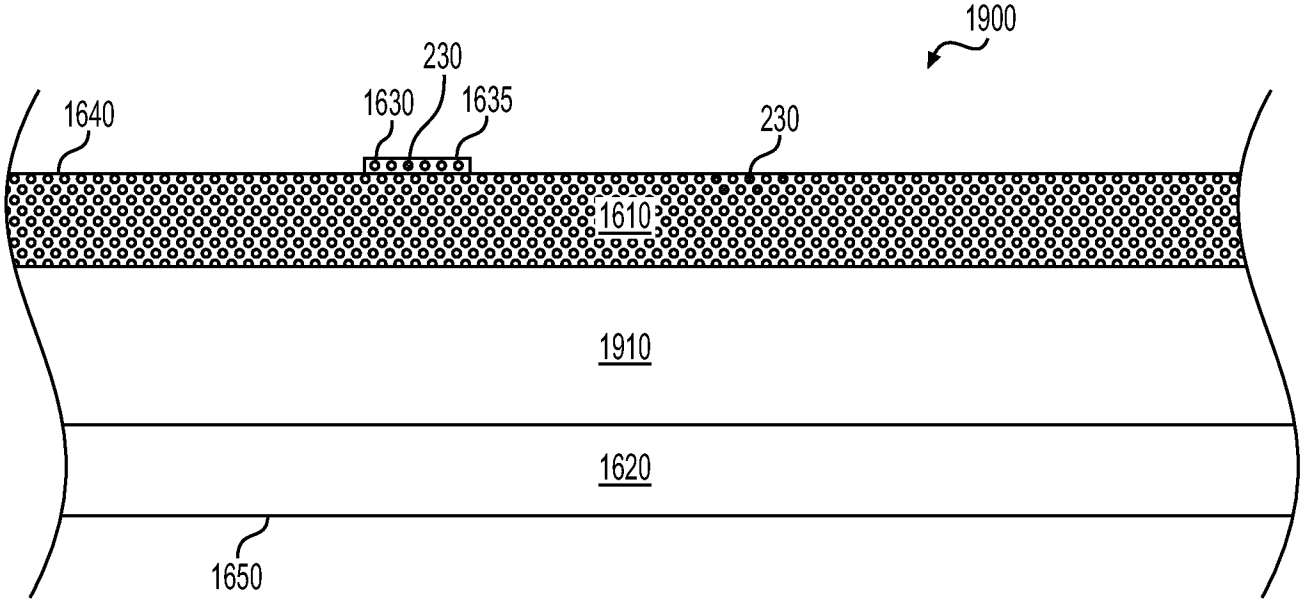
FIG. 19 is an illustration of a cross-section of another layer of material for an inner package, in accordance with at least one example embodiment.

FIG. 19 is an illustration of a cross-section of another layer of material 1900 for an inner package, in accordance with at least one example embodiment.

In at least one example embodiment, the layer of material 1900 includes a layer of cellulose 1910 between the polymer layers 1610/1620. In at least one example embodiment, the layer of cellulose 1910 includes paper, cellulose fibers, wood pulp, grasses, other vegetable materials, or combinations thereof. In at least one example embodiment, the layer of material 1900 includes only the polymer layer 1610 and the layer of cellulose 1910 but not the polymer layer 1620.

Figure 20:
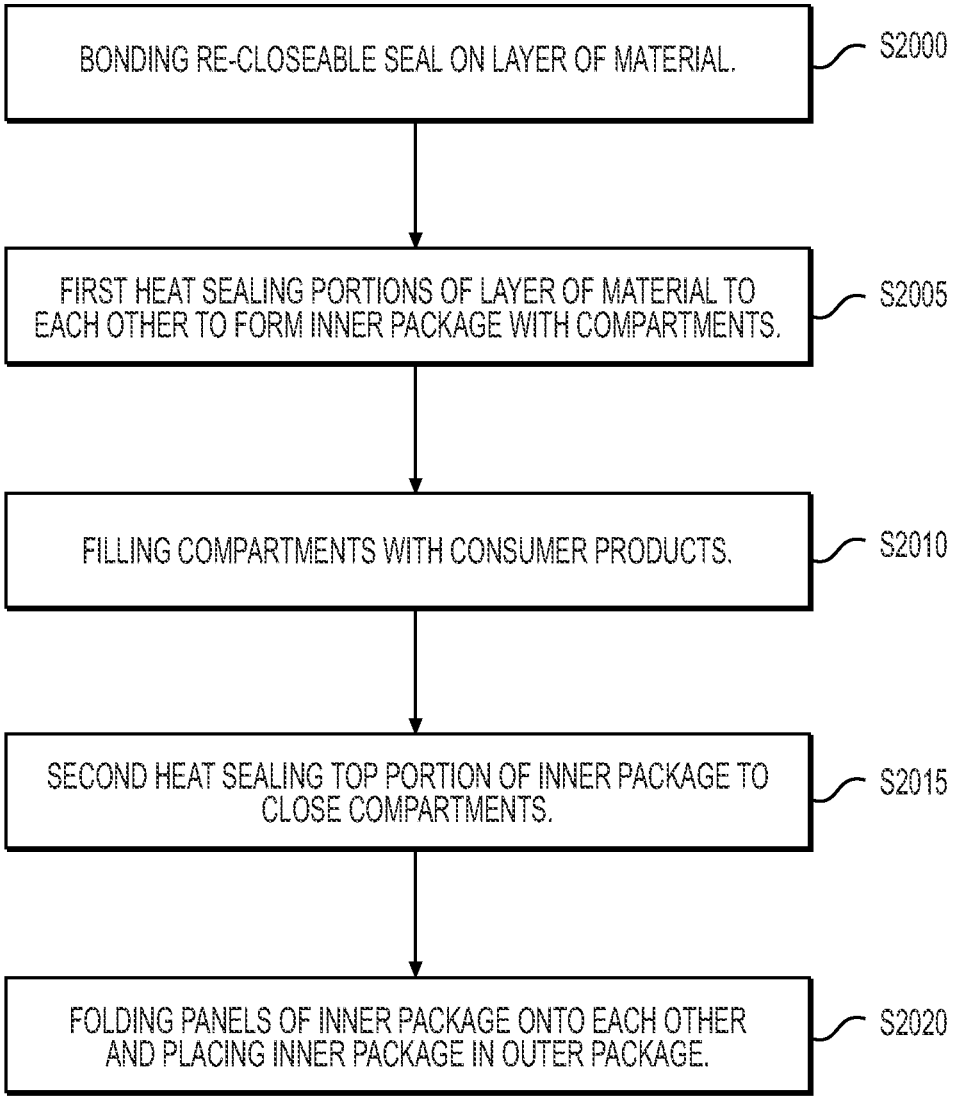
FIG. 20 is an illustration of a flowchart of a method of forming a package, in accordance with at least one example embodiment.

FIG. 20 is an illustration of a flowchart of a method of forming the package 705, in accordance with at least one example embodiment.

In at least one example embodiment, step S2000 of the method includes bonding the re-closeable seal 120, or portions of the re-closeable seal 120 (the first strip 1580 and the second strip 1585 of the re-closeable seal 120), onto the layer of material 1550, as shown for instance in FIG. 15D, 15E or 15F.

In at least one example embodiment, step S2005 includes first heat sealing portions of the layer of material 1550 to each other to form the inner package 1510 with the compartments 115 (FIG. 15F). In at least one example embodiment, this step can include folding the layer of material 1500 along the centerline 1595 (see at least FIGS. 15D, 15E and 15F), and then at least partially heat sealing the first portion 400 of the layer of material 1500 to the second portion 405 of the layer of material 1500, at least in the first heat sealed region 1515 (FIG. 15G) of the inner package 1510.

In at least one example embodiment, step S2010 includes filling the compartments 115 with the consumer products 200 (FIG. 15G), while the compartments 155 remain at least partially opened. As explained herein, this step can fill some but not all of the compartments 115.

In at least one example embodiment, step S2015 includes second heat sealing a top portion of the inner package 1510 to close the compartments 115 that contain the consumer products 200. In at least one example embodiment, this step can include heat sealing in the second heat sealed region 1535 (FIG. 15G) to close the compartments 115.

In at least one example embodiment, step S2020 includes folding the panels 110 of the inner package 1510 onto each other (see the folded configuration 1550 of the inner package 1510 in FIG. 15I), and placing the inner package 1510 into the outer package 700 to form the package 705 (FIG. 8).

Features of the example embodiments can be combined, and the features described in some of the example embodiments can be implemented in the other embodiments. In at least one example embodiment, the layer of materials described in FIGS. 16-18 can be used to make any of the inner packages (e.g., inner packages 100, 1100, 1200, 1300, 1400 and 1510). In at least one example embodiment, features of the panels, compartments, re-closeable seals, use of heat sealing (crimping), materials of construction, consumer products, inner packages and outer packages can be implemented or combined within each of the example embodiments.

Example embodiments have been disclosed herein, it should be understood that other variations may be possible. Such variations are not to be regarded as a departure from the spirit and scope of the present disclosure, and all such modifications as would be obvious to one skilled in the art are intended to be included within the scope of the following claims.

We claim:

1. A package, comprising:

an inner package including a first panel defining a first compartment, the first panel including a first end that is at least partially heat sealed, the first end defining a first tear-point that is configured to allow a first portion of the first end to be removed to allow access to a first re-closeable seal, a second panel defining at least one second compartment, a first interfacing edge of the first panel being connected to a second interfacing edge of the second panel, the second panel including a second end that is at least partially heat sealed, the second end defining a second tear-point that is configured to allow a second portion of the second end to be removed to allow access to a second re-closeable seal, the at least one second compartment including a first filled compartment containing a first set of pouches with a first quantity of consumer product pouches that are to be consumed during a first expected duration of time based on an average consumption rate, the first expected duration of time being shorter than a second expected duration of time, the second expected duration of time being a time period upon which flavor scalping is expected to occur for the first quantity of the consumer product pouches following an exposure to ambient air, and the first re-closeable seal and the second re-closeable seal being on a third end of the first compartment and a fourth end of the at least one second compartment, respectively.

2. The package of claim 1, wherein the first panel and the second panel are configured to be folded onto each other.

3. The package of claim 2, wherein the first end defines a first slit and the second end defines a second slit, and the first slit and the second slit are configured to align once the first panel and the second panel are folded onto each other.

4. The package of claim 1, wherein the first compartment includes a first empty compartment that is empty, and the at least one second compartment further includes a second filled compartment containing a second set of pouches.

5. The package of claim 4, wherein the first empty compartment is a different size than the first filled compartment and the second filled compartment.

6. The package of claim 4, wherein the second set of pouches also includes the first quantity of consumer product pouches.

7. The package of claim 1, further comprising:

an outer package, wherein the inner package is inside the outer package.

8. The package of claim 1, wherein at least one tear line is defined by the first interfacing edge and the second interfacing edge.

9. The package of claim 1, further comprising:

an adhesive on at least a portion of a major interfacing surface between each of the first panel and the second panel to hold the inner package in a folded configuration, the folded configuration including the first panel and the second panel being folded onto each other.

10. The package of claim 1, wherein the first panel includes a plurality of first panels that are subdivided by tear lines, the plurality of first panels defining a plurality of first compartments that are the same as the first compartment.

11. The package of claim 10, wherein the plurality of first panels and the second panel are folded onto each other in an accordion configuration, and the inner package is configured to allow at least one of a first end panel or a second end panel, of the plurality of first panels and the second panel, to be separated and extended from sides of the accordion configuration.

12. The package of claim 11, wherein at least one tear line is defined by the inner package, the at least one tear line being configured to allow at least one of the first end panel or the second end panel to be removed from a remainder of the inner package.

13. The package of claim 12, wherein the plurality of first panels and the second panel are made from a recyclable material.

14. The package of claim 11, wherein the plurality of first compartments include one or more empty compartments, and the second panel includes a plurality of second panels that define a plurality of second compartments, each one of the plurality of second compartments being filled compartments containing sets of pouches of a consumer product.

15. The package of claim 1, wherein the first panel and the second panel are made from a recyclable material.

16. The package of claim 1, wherein the first panel and the second panel are made from a layer of material, the layer of material including at least one first polymer layer and a gas/moisture impermeable layer, the at least one first polymer layer forming an interior surface of the first compartment and the at least one second compartment.

17. The package of claim 16, wherein the gas/moisture impermeable layer is a foil layer.

18. The package of claim 1, wherein the first panel and the second panel are made from a layer of material that includes at least one gas/moisture impermeable layer, and an oxygen scavenger is one of enclosed within the first compartment, enclosed within the at least one second compartment, infused within the layer of material, or connected to or infused with an inner layer of the layer of material, the inner layer forming an interior surface of the first compartment and the at least one second compartment.

19. A package, comprising:

an inner package including a first panel defining a first compartment, the first panel including a first end that is at least partially heat sealed, the first end defining a first tear-point that is configured to allow a first portion of the first end to be removed to allow access to a first re-closeable seal, a second panel defining at least one second compartment, a first interfacing edge of the first panel being connected to a second interfacing edge of the second panel, the second panel including a second end that is at least partially heat sealed, the second end defining a second tear-point that is configured to allow a second portion of the second end to be removed to allow access to a second re-closeable seal; and an outer package, the inner package being contained in the outer package, wherein the first end defines a first slit and the second end defines a second slit, the first panel and the second panel being folded onto each other such that the first slit is aligned with the second slit, and the outer package defines at least one third slit, the at least one third slit being aligned with the first slit and the second slit, the first re-closeable seal and the second re-closeable seal being on a third end of the first compartment and a fourth end of the at least one second compartment, respectively.

* * * * *